US012385366B1

(12) United States Patent
Greci et al.

(10) Patent No.: US 12,385,366 B1
(45) Date of Patent: Aug. 12, 2025

(54) VORTEX FILTRATION FOR DEBRIS-SENSITIVE COMPONENTS IN A WELL

(71) Applicant: Halliburton Energy Services, Inc., Houston, TX (US)

(72) Inventors: Stephen Michael Greci, Carrollton, TX (US); Michael Linley Fripp, Singapore (SG); Ryan W. McChesney, Carrollton, TX (US); Ryan M. Novelen, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/615,439

(22) Filed: Mar. 25, 2024

(51) Int. Cl.
*E21B 43/08* (2006.01)
*E21B 47/06* (2012.01)
*E21B 47/10* (2012.01)

(52) U.S. Cl.
CPC ..... *E21B 43/084* (2013.01); *E21B 47/06* (2013.01); *E21B 47/10* (2013.01)

(58) Field of Classification Search
CPC ..... E21B 43/08; E21B 43/084; E21B 47/06; E21B 47/10
See application file for complete search history.

(56) References Cited

U.S. PATENT DOCUMENTS

| | | | | |
|---|---|---|---|---|
| 3,561,605 | A | 2/1971 | Likness | |
| 4,201,266 | A | 5/1980 | Calderon et al. | |
| 4,857,175 | A | 8/1989 | Spinnler | |
| 11,286,732 | B1 * | 3/2022 | Teodorescu | E21B 27/005 |
| 2011/0168397 | A1 | 7/2011 | Churchill | |
| 2012/0181037 | A1 * | 7/2012 | Holderman | E21B 34/08 166/319 |
| 2016/0160616 | A1 * | 6/2016 | Moen | E21B 43/12 166/227 |
| 2017/0362919 | A1 * | 12/2017 | Lazo | E21B 43/08 |
| 2020/0011153 | A1 | 1/2020 | Fripp et al. | |

FOREIGN PATENT DOCUMENTS

| | | | |
|---|---|---|---|
| CN | 215595554 | U | 1/2022 |
| CN | 113027364 | B | 5/2023 |
| WO | 2023172344 | A1 | 9/2023 |

OTHER PUBLICATIONS

Foreign Communication from Related Application—International Search Report and Written Opinion of the International Searching Authority, International Application No. PCT/US2024/023704, dated Dec. 17, 2024, 10 pages.

* cited by examiner

*Primary Examiner* — Caroline N Butcher
(74) *Attorney, Agent, or Firm* — Conley Rose, P.C.; Rodney B. Carroll

(57) ABSTRACT

An apparatus for supplying clean fluid to a component in a well may include a filter. The filter may include a housing having an outlet, a conical permeable element disposed at least partially inside the housing, and a tapered helical coil disposed at least partially inside the permeable element. A first opening may be formed at a first axial end of the permeable element, and a second opening may be formed at a second axial end of the permeable element. The apparatus may further include first conduit fluidly coupling the outlet and the component, and a second conduit fluidly coupling the second opening and a tubular of the well.

20 Claims, 10 Drawing Sheets

VORTEX FILTRATION FOR DEBRIS-SENSITIVE COMPONENTS IN A WELL

CROSS-REFERENCE TO RELATED APPLICATIONS

None.

STATEMENT REGARDING FEDERALLY SPONSORED RESEARCH OR DEVELOPMENT

Not applicable.

FIELD

The present disclosure relates generally to a system and method for supplying clean fluid to a component in a well. More particularly, the present disclosure relates to using a filter, for example, a vortex filter, to supply clean fluid to a component in a well.

BACKGROUND

As technology advances in the field of oil and natural gas, parts tend to get smaller, and there tends to be more moving parts and sensors. These components may not function well in debris laden environments. This debris (e.g., particulates in the oil or other fluid in the well) can cause problems for sensitive components. For example, particulates in fluid can be abrasive, which can lead to accelerated wear and tear of downhole equipment components such as pumps, valves, and/or seals. This abrasion can reduce the efficiency of equipment, cause damage to critical components, and/or eventually lead to equipment failure. Additionally, fine particulates can accumulate and lead to clogging of downhole tools and/or filters, which can restrict oil flow, reduce production rates, and/or increase the need for maintenance and cleaning operations. In severe cases, blockages can lead to the shutdown of the well for cleaning and repair, which can be costly and time-consuming. While particulates themselves may not always be directly corrosive, in instances their presence can facilitate corrosion by trapping moisture against metal surfaces or by creating areas where corrosive compounds can concentrate. This can lead to pitting, material loss, and/or ultimately, failure of downhole components. Oftentimes, particulates can interfere with the proper functioning of seals and packers by getting lodged in sealing surfaces, leading to leaks and/or loss of well control. This can compromise the integrity of the well, which can pose environmental and safety risks. Downhole sensors and control equipment may be sensitive to contamination. For example, particulates can obscure sensors, interfere with electronic signals, and/or cause inaccurate readings, making it difficult to monitor and control well conditions effectively. The presence of particulates can increase the need for maintenance of downhole equipment to repair damage caused by abrasion, clogging, and/or other issues. This can result in increased operational costs and downtime, reducing the overall efficiency and profitability of the well. And while particulates may generally cause damage to elements within the well, particles in the range of 20-50 microns in particular can do severe damage over the course of decades.

To attempt to mitigate these problems, sand screens have been used. However, conventional sand screens can still allow particles and debris below a certain size to freely pass through, which may damage equipment. In an attempt to filter out these particles, conventional filters have been used. However, conventional filters may suffer from various problems. For example, conventional filters can become clogged with particulates over time, which can significantly reduce the flow rate of oil through the system. This reduction in flow can decrease production efficiency and/or require frequent shutdowns for filter cleaning or replacement, leading to increased operational costs and downtime. Conventional filters can also require regular maintenance and eventual replacement to ensure effective particulate removal. The costs associated with purchasing new filters, along with the labor costs for maintenance and replacement, can add up, impacting the overall operational budget. Furthermore, as filters capture particulates, they can create significant pressure drops across the filtration system. These pressure drops can affect the overall efficiency of the oil production system, requiring more energy to pump oil through the filter and possibly impacting the performance of downhole equipment.

Accordingly, there may be a need for an improved system and method for supplying clean fluid to a component of a well that, for example, avoids clogging, requires little or no maintenance, and/or does not create an excessive pressure drop across the filtration system.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid, for example relative to flow of well fluid in the well. As used herein, orientation terms "upstream," "downstream," are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid.

Figure 1:
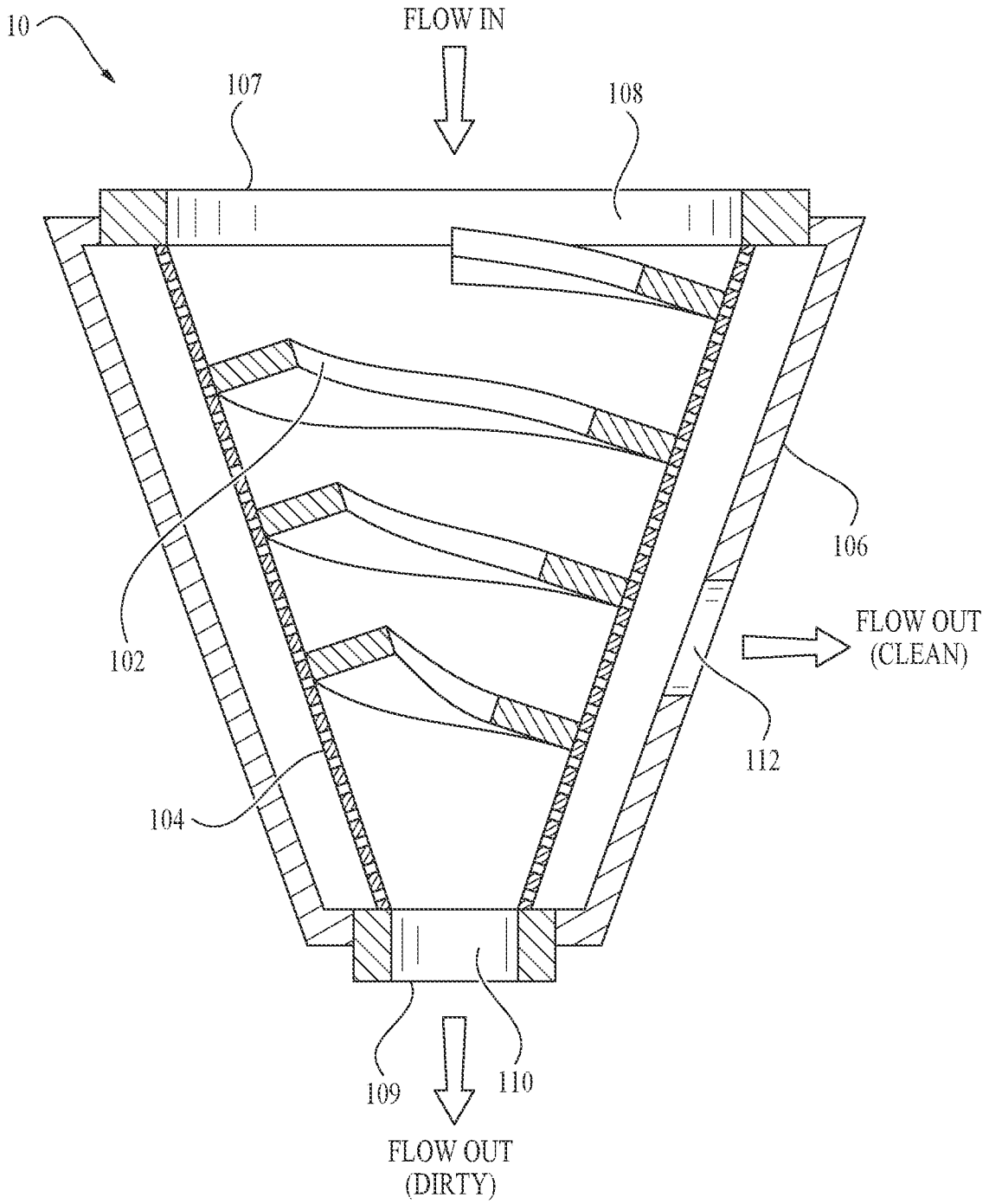
FIG. 1 is a cross-sectional side view of an exemplary vortex filter, according to an embodiment of the present disclosure.

Referring to FIG. 1, an exemplary vortex filter 10 according to an embodiment is disclosed. In some embodiments, the vortex filter 10 can have a tapered (e.g, wider on one axial end than the other axial end) helical (e.g., spiral-shaped) coil 102 that generally decreases in diameter as extending (e.g. axially) in a direction of fluid flow therethrough. The tapered helical coil may be disposed within a permeable element 104, which may also taper to decrease in diameter as it extends (e.g. axially) in a direction of fluid flow. In embodiments, the permeable element 104 may be conical in shape, and the tapered helical coil may be configured to fit within the interior space of the conical permeable element 104, for example disposed in proximity to and/or attached to the inner surface of the conical permeable element 104. Fluid can enter the vortex filter 10 through a first opening 108 and exit through a second opening 110, with the second opening 110 typically being smaller (e.g. having a smaller diameter) than the first opening 108. The tapered helical coil 102 may extend away from the first opening 108 towards the second opening 110. In embodiments, the second opening 110 may be opposite the first opening 108. As the fluid passes from first opening 108 to second opening 110, the shape of tapered-helical coil 102 may generate vortices in the fluid, which may promote movement of particles to be filtered along a particle flow path (e.g., toward second opening 110), while filtered fluid flow is able to exit through an outlet 112, such as by cross-flow filtration across a permeable element 104 (e.g., filter media such as mesh). The permeable element 104 may surround the tapered helical coil 102, for example extending away from the first opening 108 towards the second opening 110. In some embodiments, the permeable element 104 may be integrated directly with the tapered-helical coil 102. In some embodiments, the permeable element 104 may be attached to the tapered-helical coil 102 as part of a housing 106. The housing 106 may be, for example, conical in shape and at least partially surround the tapered helical coil 102 and the permeable element 104. As used herein, "conical" may be used to refer to frusto-conical shapes and/or conical shapes with frustums and/or elliptical cones. The first opening 108 may be a first opening 108 in the housing 106 and/or the permeable element 104. The second opening 110 may be an opening in the housing 106 and/or the permeable element 104. In some embodiments, element 102 may be a helix.

In some embodiments, the tapered helical coil 102 may form a flow guide for a particle flow path of fluid flowing through vortex filter 10. In some embodiments, the tapered-helical coil 102 may be a continuous flow guide (e.g., unbroken from start to finish) along the fluid flow direction from the first opening 108 to the second opening 110. In some embodiments, the particle flow path may be substantially unobstructed to facilitate the flow toward second opening 110 along tapered-helical coil 102. The permeable element 104 (e.g., a mesh or membrane) may be provided around the tapered-helical coil 102 (e.g., partially or completely surrounding lateral sides of the tapered helical coil 102), to allow for filtration, for example, cross-flow filtration along particle flow path. For example, as fluid flows along the particle flow path for fluid, fluid and particles smaller than the filtration capabilities of the permeable element may pass through permeable element 104 to the exterior of the permeable element 104; fluid and particles too large to pass through the permeable element 104 may continue along the particle flow path towards the second opening 110. In some embodiments, the housing 106 may have the outlet 112 formed therein, and the conical permeable element 104 can be disposed at least partially inside the housing 106. In some embodiments, the first opening 108 may be formed at a first axial end 107 of the permeable element 104 and the second opening 110 may be formed at a second axial end 109 of the permeable element 104. In some embodiments, the tapered helical coil 102 may be disposed at least partially inside the permeable element 104. The first axial end 107 of the permeable element 104 need not be a first axial end of the vortex filter 10; in some embodiments, the first axial end 107 of the permeable element 104 may be disposed axially inward from a first axial end of the vortex filter 10. Likewise, the second axial end 109 of the permeable element 104 need not be a second axial end of the vortex filter 10; in some embodiments, the second axial end 109 of the permeable element 104 may be disposed axially inward from a second axial end 109 of the vortex filter 10.

In some embodiments, the conical permeable element 104 may include an (e.g. first) open interior volume (e.g. the permeable element 104 may be hollow). The conical permeable element 104 may include a conical permeable wall, for example extending axially between the first axial end 107 and the second axial end 109 to form the conical shape. The permeable wall may be configured for filtration, for example comprising mesh or other filtration material. The housing 106 may be configured to receive and/or retain the conical permeable element 104. The housing 106 may include an (e.g. second) open interior volume (e.g. the housing may be hollow). The housing 106 may be configured to allow/provide fluid communication of fluid flow in through the first opening 108 and out through the second opening 110. The second opening 110 can be at the second axial end 109 (as shown). It can also be in the wall of the conical section. The housing 106 may encompass/enclose the conical permeable element 104 and/or may be configured so that the only fluid flow into the conical permeable element 104 is through the first opening 108. In embodiments, the housing may be conically shaped, for example having sidewalls configured to be approximately parallel to those of the conical permeable element 104. For example, the permeable element 104 and the housing 106 may be configured as concentric cones, with the housing 106 outside of the permeable element 104. In another embodiment, the outer wall may be cylindrically shaped and have a consistent diameter. In other embodiments, the housing 106 may have a shape which is non-conical and/or different from that of the permeable element 104.

In some embodiments, the coil 102 may not be touching the permeable element 104. It may be spaced off of the filter. In some embodiments, coil 102 may not have an open center. It may be shaped more like a Christmas tree. In some embodiments, spiral does may not be axially collocated with the screen. It may be upstream of the screen and the fluid may be still spinning when it hits the screen. In some embodiments, screen may not be straight. It may be a curved shape to account for the flow velocity changing inside the device. It may be curved for maintaining a consistent flow on the surface of the screen. In some embodiments, the flow velocity across the screen is approximately constant (e.g., the flow does not vary from the mean flow by greater than +/−25%). In some embodiments, a pressure differential is created by the spinning. There may be higher pressure at the screen when there is more centripetal forces against the screen. This may be helpful to push fluid through the screen.

Figure 9:
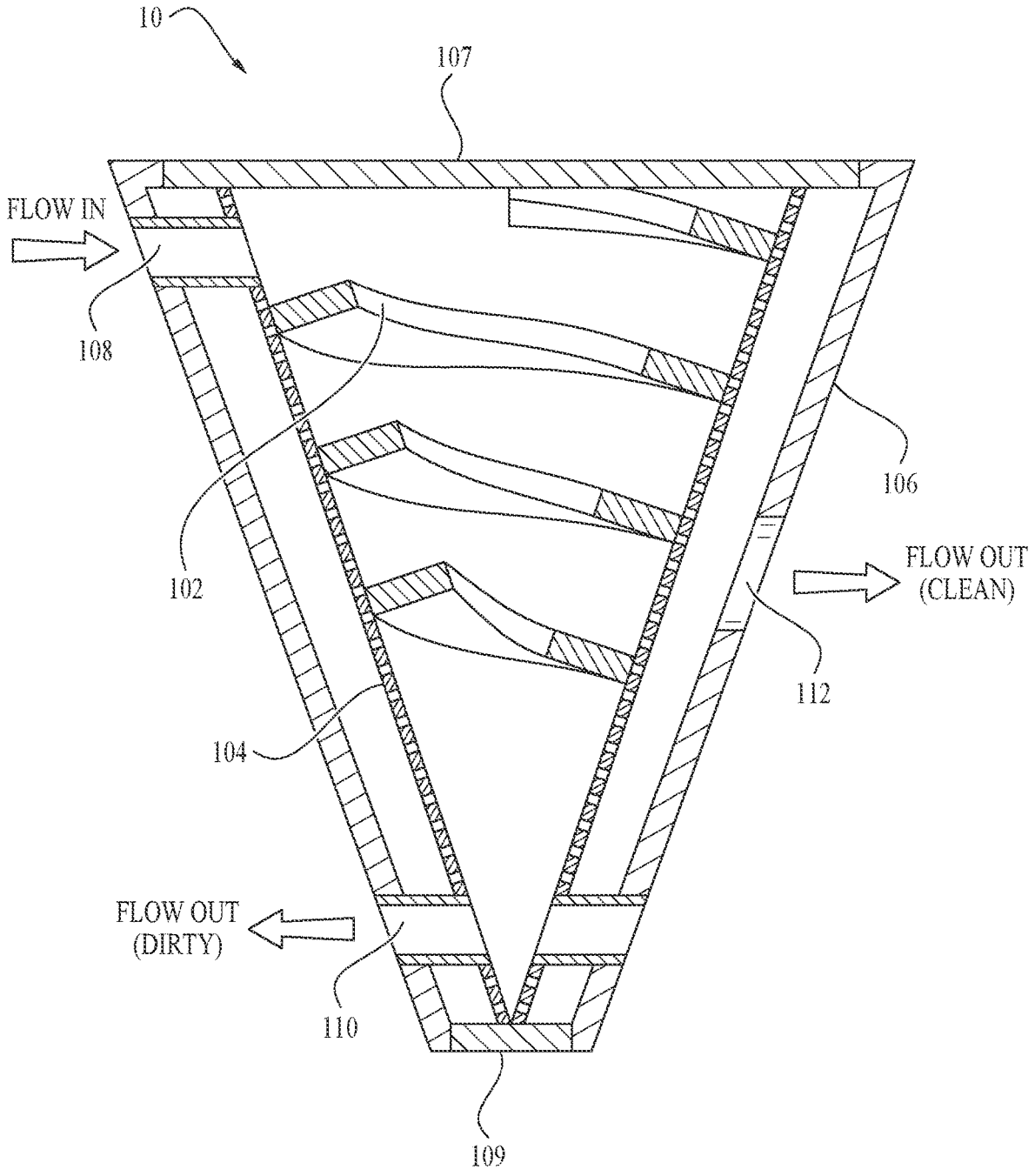
FIG. 9 is a cross-sectional side view of an exemplary vortex filter, according to another embodiment.

Referring to FIG. 9, an alternative embodiment of the filter 10 is shown. The first opening 108 may be extend through the housing 106 and through the permeable element 104 (i.e., through the side of the cone shape). The second opening 110 may extend through the housing 106 and through the permeable element 104 (i.e., through the side of the cone shape). The first opening 108 may be spaced apart from the second opening 110 (e.g., the first opening 108 may be positioned proximate the first axial end 107 and the second opening 110 may be positioned proximate the second axial end 109). In some embodiments, there is flow in through the first opening 108 which is disposed proximate the first axial end 107 but not at the first axial end 107. That is, flow in through the vortex filter 10 may be from the side at a location axially inward from a first axial end of the vortex filter 10. In some embodiments, the dirty fluid flows out the second opening 110 which is disposed proximate the second axial end 109 but not at the second axial end 109. That is, flow of dirty fluid out of the vortex filter may be through the side at a location axially inward from a second axial end of the vortex filter 10.

Components of the vortex filter 10 and/or the vortex filter 10 itself may be conical. The conical shape may be advantageous because it can cause a pressure drop along the axial length of the filter 10, which can help push the fluid through the permeable wall of the permeable element 104 (e.g., membrane or mesh or other filtration material). This may help induce favorable fluid flow (e.g., vortices) within the vortex filter 10. In some embodiments, the conical shape of the housing 106 may be larger than the conical shape of the permeable element 104. In embodiments, the housing 106 may have approximately the same conical shape (e.g. the same degree of taper) as the permeable element 104. The housing 106 and/or the permeable element 104 may taper uniformly or non-uniformly. The housing 106 may taper differently than the permeable element 104 or the same as the permeable element 104. The housing 106 may include a housing wall oriented approximately parallel to the permeable element 104. A gap between the housing 106 and the permeable element 104 may be approximately uniform along a length of the permeable element 104. The housing 106 may enclose a volume (e.g. an exterior volume) outside of the permeable element 104 and between the first axial end 107 and the second axial end 109. The volume may be disposed between the permeable element 104 and the housing wall.

The outlet 112 may be disposed in the permeable wall approximately midway between the first axial end 107 and the second axial end 109, although in other embodiments the outlet 112 may be disposed closer to the first axial end 107 or closer to the second axial end 109. In some embodiments, the outlet 112 may comprise a plurality of outlets (which may co-join to all flow to the first conduit 202), although a single larger outlet may be used. The outlet 112 may have a circular cross section, a rectangular cross section, or any other suitable shape. Cross-sectional area of the outlet 112 may be larger, smaller, or the same size as the cross-sectional area of the first opening 108 and/or the cross-sectional area of the second opening 110. The In some embodiments, the first opening 108 may have a circular cross section. In some embodiments, the second opening 110 may have a circular cross section. In some embodiments, the outlet 112 may have a circular cross section. The first opening 108 may be larger than the second opening 110.

As shown in FIG. 1, the permeable element 104 may be conically-shaped, tapering from the larger first opening 108 to the smaller second opening 110. In some embodiments, the conical permeable element 104 may taper at a uniform rate (e.g. a set angle to a plane of the first axial 107 end and/or first opening 108). In some embodiments, the conical permeable element 104 tapers non-uniformly (e.g. with at least a portion of the taper comprising curvature or two or more angles). In some embodiments, substantially an entire surface of the permeable wall of the permeable element 104 may be mesh (e.g. at least 90%). In some embodiments, the mesh may allow particles of approximately 10 microns and smaller to pass therethrough and prevent particles of greater than approximately 10 microns from passing therethrough. In some embodiments, the mesh may allow particles of approximately 100-125 microns and smaller to pass therethrough and prevent particles of greater than approximately 100-125 microns from passing therethrough. The mesh may be configured to filter particles smaller than particles that the sand filter is configured to filter. The particles may include sand particles and/or other particles that may be found in the well or in the rock formation around the well. The fluid may include hydrocarbons, oil, a mixture of water, or any other fluid flowing from the well. In some embodiments, the permeable element 104 may include a fluid selective membrane or a fluid selective membrane may be included in addition to the permeable element 104. In some embodiments, the fluid selective membrane may only allow water to pass, only allow oil to pass, only allow gas to pass, only allow liquids to pass, or combinations thereof. The fluid selective membrane may alternatively restrict but still allow some flow of water, oil, gas, liquids, or combinations thereof. In some embodiments, alternatively or in addition to the mesh, the permeable element may include a wire wrapped construction.

In some embodiments, the flow path of the fluid is consistent regardless of the composition of the liquid. In some embodiments, the amount of restriction does not vary as the composition of the flow changes. In some embodiments, there is a consistent flow restriction within the filter 10.

In some embodiments, the first opening 108 can be defined by a first ring at the first axial end 107. The ring may be fastened to either one or both of the permeable element 104 and the housing 106. The second opening 110 may be defined by a second ring at the second axial end 109. The second ring may be fastened to either one or both of the permeable element 104 and the housing 106. For example, the first and/or second ring may be configured to sealingly attach the permeable element 104 within the housing 106. In some embodiments, the first opening 108 may be concentric with the second opening 110 (e.g. sharing a common central axis, although axially spaced apart). In some embodiments, the first ring may be concentric with the second ring. The first ring may have a first inner diameter, the second ring may have a second inner diameter, and the first inner diameter may be greater than the second inner diameter.

In some embodiments, the outer contour of the helical coil 102 may be tapered (e.g., the helical coil 102 decreases in width moving along a length of the helical coil 102). The outer contour of the helical coil 102 may correspond in shape to an inner surface of the permeable wall of the permeable element 104. In some embodiments, the helical coil 102 may contact the inner surface of the permeable wall. In some embodiments, the coil 102 may be mounted on the inner surface of the permeable wall. The tapered helical coil 102 may be fixed in relation to the permeable wall. In some embodiments, the tapered helical coil 102 may include an (e.g. axial) passage, for example extending from the first opening 108 to the second opening 110 (e.g, wherein the passage forms an inner contour of the coil 102). In some embodiments, the passage may taper moving from the first axial end of the permeable wall to the second axial end of the permeable wall (e.g. with the passage having a larger diameter at the first axial end and a smaller diameter at the second axial end). The passage may extend from the first opening 108 to the second opening 110. In embodiments, the passage may be straight and/or extend axially. In some embodiments, an inner contour of the helical coil 102 is tapered. In some embodiments, the helical coil 102 may not be continuous; it may have one or more breaks in it.

In some embodiments, the coil 102 may be configured to induce the fluid to follow a tapered helical path from the first opening 108 towards the second opening 110. In embodiments, the tapered helical coil 102 may be configured to induce vortices in the fluid about the tapered helical path and/or in proximity to the permeable wall of the permeable element 104 (e.g. its inner surface). The vortices may mitigate buildup of particles on the permeable wall (e.g. clean away particulates that might otherwise clog the mesh of the permeable wall). The vortices may carry particles that are too large to pass through the permeable wall from a surface of the permeable wall towards a centerline of the filter 10 (e.g. inward towards the passage) and/or downward along a ramp/inclined surface of the coil 102. The tapered helical coil 102 (and its interaction with the inner surface of the permeable wall) may be configured so the vortices carry particles that are too large to pass through the permeable wall from an inner surface of the permeable wall towards a centerline of the filter 10 (e.g. inward towards the passage) and/or downward along the ramp/inclined surface of the tapered helical coil 102. The helical coil 102 may taper moving from the first opening 108 towards the second opening 110. In some embodiments, the coil may have a uniform screw angle. In some embodiments, the coil 102 may have a graduated screw angle. In some embodiments, the tapered helical coil 102 may form a ramp/inclined surface spiraling to extend downward from the first opening 108 towards the second opening 110.

In some embodiments, the tapered helical coil 102 has a uniform thickness/width. The width may be sufficient to withstand forces of the current within the vortex filter 10. The spiraling ramp/inclined surface of the tapered helical coil 102 may form levels, and spacing between the levels may be set to optimize fluid flow and filtration. The tapered helical coil 102 may have a tapering thickness/width. The tapered helical coil 102 may have an open center (e.g. passage) along a centerline of the vortex filter 10 and/or the permeable wall of the permeable element 104. The open center may allow particles that are unable to pass through the permeable wall to exit the vortex filter 10 through the second opening 110 (e.g. fluid having particles too big to pass through the mesh of the permeable wall instead exit through the second opening 110). The tapered helical coil 102 may be substantially impermeable and rigid. The tapered helical coil 102 may include a ramp/inclined surface, and in embodiments the coil 102 may extend from the permeable wall approximately perpendicularly with respect to the permeable wall. The outlet 112 may allow particles that pass through the permeable wall of the permeable element 104 to exit the vortex filter 10 (e.g. fluid without particles larger than allowed to pass through the permeable wall may exit through the filter 10 via the outlet 112 to the first conduit 202).

In operation, fluid and suspended particles enter the first opening 108. The fluid flow may push the particles and fluid radially outward toward the sides of the tapered-helical coil 102 to create vortices. The permeable element 104 surrounding the tapered-helical coil 102 may prevent particles larger than a certain size (e.g., larger than the mesh size or pore size of the permeable element 104) from exiting the vortex filter 10 through the outlet 112. Fluid may exit through permeable element 104 after passing through open spaces in the tapered-helical coil 102, such as by cross-flow filtration (e.g., the fluid flows parallel to the surface of the permeable element 104. The geometry of the tapered helical coil 102 may cause particles to travel with vortices along the tapered helical coil 102 along a particle flow path along the tapered helical coil 102 toward the outlet 112 as fluid flows through the vortex filter 10. Vortices caused by the tapered-helical coil 102 may cause particles to be constantly mixed back into the fluid flow, either along the particle path or back into the center of the tapered helical coil 102. These vortices also may contribute to cross-flow filtration across the permeable element 104. Because the vortices can cause the particles to remain in suspension rather than becoming caked on the permeable element 104 or the tapered helical coil 102, the formation of vortices and the particle flow path towards the second opening 110 may prevent buildup of filtered particles on/along/in the permeable element 104, thereby maintaining filter efficiency over continued use. The permeable element 104 can be configured to appropriately filter (e.g., using a particular mesh size or pore size) particles of a certain size. The tapered helical coil 102 may generate vortices, eddies, or any fluid flow mechanism that entrains, concentrates, or transports particles suspended therein, generally along a spiral, looping, or winding path along the tapered helical coil 102 towards the second opening 110. This fluid motion may help prevent the filter 10 from clogging. The inertia (e.g., centrifugal force) of particles below a threshold size (e.g., the mesh size of the permeable element 104) may tend to move these small particles radially outward within the filter 10 and they may be allowed to pass through the permeable element 104 because of their small size. Likewise, the inertia (e.g., centrifugal force) of particles above the threshold size may tend to move these particles radially outward within the filter 10, however, because of their large size, they may not be allowed to pass through the permeable element 104. The vortices and/or other fluid flow within the filter 10 may then tend to carry these large particles radially inward and/or axially so that they may exit through the second opening 110.

Figure 2:
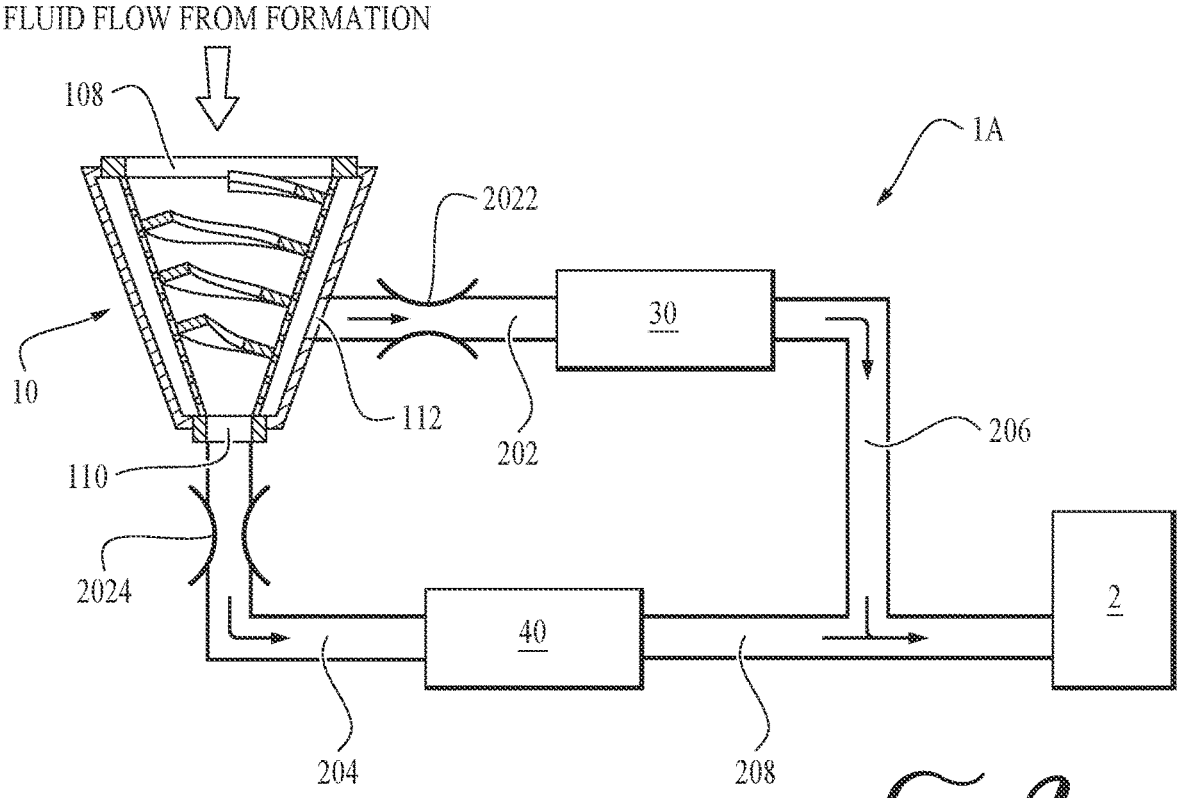
FIG. 2 is a schematic diagram of an exemplary apparatus for supplying clean fluid to a component, according to an embodiment of the present disclosure.

Referring to FIG. 2, an exemplary apparatus is disclosed for supplying clean fluid to a component 30 in a well according to an embodiment. In some embodiments, the apparatus 1A includes the filter 10. In some embodiments, a first conduit 202 may fluidly couple the outlet 112 and the component 30. In some embodiments, the outlet 112 is formed in the housing wall of the housing 106 and provides fluid communication from the (e.g. exterior) volume and a first conduit 202 (see FIG. 2). A second conduit 204 may fluidly couple the second opening 110 and a tubular 2 of the well. The apparatus 1A may further include a third conduit 206 fluidly coupling the component 30 to tubular 2 and/or a fourth conduit 208 fluidly coupling the other component 40 and the tubular 2 of the well. The first opening 108 may be configured to receive fluid from a formation adjacent the well. In some embodiments, the first conduit 202 may have a first valve 2022 disposed thereon, and the second conduit 204 may have a second valve 2024 disposed thereon. The component 30 may be sensitive to particulates greater than approximately 100 microns or approximately 125 microns or approximately 10 microns (e.g. depending on the system). By way of example, the component 30 may include a fluid sensor, a turbine generator, a power generator, a fluid sensor, a flow rate sensor, a fluid actuator, a flow rate controller, a valve, or combinations thereof. The filtration of the permeable element 104 may be set based on the sensitivity of the component 30, for example with filtered flow from the outlet 112 interacting with component 30. In some embodiments, the apparatus further includes another component 40 not sensitive to particulates of a certain size or is less sensitive than the component 30. The other component 40 may be a non-sensitive component which is capable of handling (e.g. not being damaged by) fluid having larger particulates. In some embodiments, the second conduit 204 fluidly couples the vortex filter 10 (e.g. second opening 110) and the other component 40, for example with fluid having larger unfiltered particulates interacting with other component 40. In some embodiments, a fourth conduit 208 couples the other component 40 and the tubular 2. In some embodiments, the arrows indicate a direction of flow.

In some embodiments, the apparatus 1A may further include a first valve 2022 disposed on the first conduit 202. A second valve 2024 may be disposed on the second conduit 204. In another embodiment, apparatus 1A may also include the other component 40 (e.g. a non-sensitive component which is capable of handling/not damaged by fluid having larger particulates). The second conduit 204 may include a conduit/flowpath/portion leading from the second opening 110 to the other component 40, and a fourth conduit 208 may include conduit/flowpath/portion leading from the other component 40 to the tubular. The other component 40 may include a turbine generator, a nozzle, a flow control device, a valve, a power generator, or combinations thereof. In embodiments, flow through the third conduit 206 and flow through the fourth conduit 208 may comingle before entering the tubular 2. Flow through the second conduit 204 may enter the tubular 2 through an opening that is formed in a circumferential surface of the tubular 2. Flow through the fourth conduit 208 may enter the tubular 2 through an aperture in the tubular. In some embodiments, the first conduit 202 may include one or more pipes, the second conduit 204 may include one or more pipes, and the third conduit 206 may include one or more pipes.

In some embodiments, such as the embodiment of FIG. 1B (shown in FIG. 3), the apparatus 1B may not include the other component 40 or fluid flow thereto. That is, the apparatus 1B may have one or more components in fluid communication with the outlet 112 via the first conduit 202. In some embodiments, these one or more components 30 may be components that are sensitive to particles in the fluid and whose life may be prolonged by the vortex filter 10 filtering out relatively large particles in the fluid. In some embodiments, such as the embodiment of FIG. 3, the apparatus may not include the other component 40. Instead, the second conduit 204 may lead directly from the second opening 110 of the filter 10 to the tubular 2.

Figure 3:
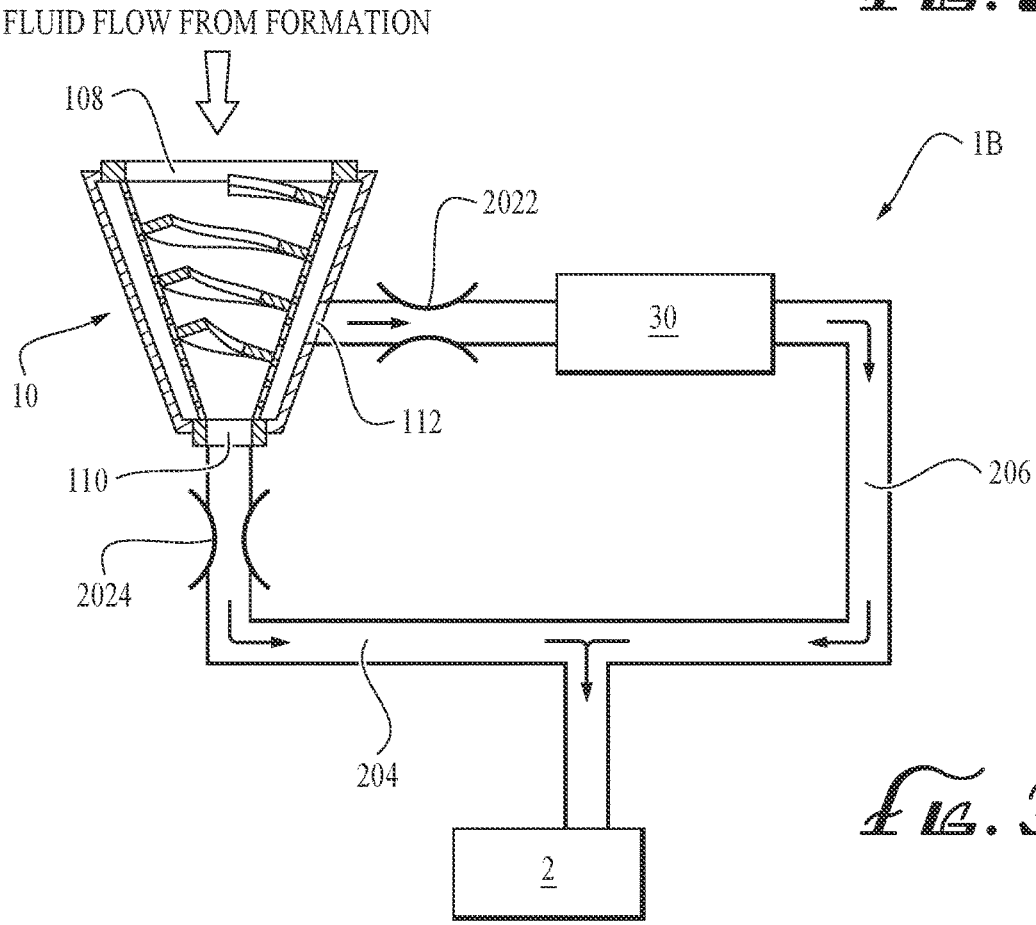
FIG. 3 is a schematic diagram of an exemplary apparatus for supplying clean fluid to a component, according to another embodiment of the present disclosure.
Figure 5:
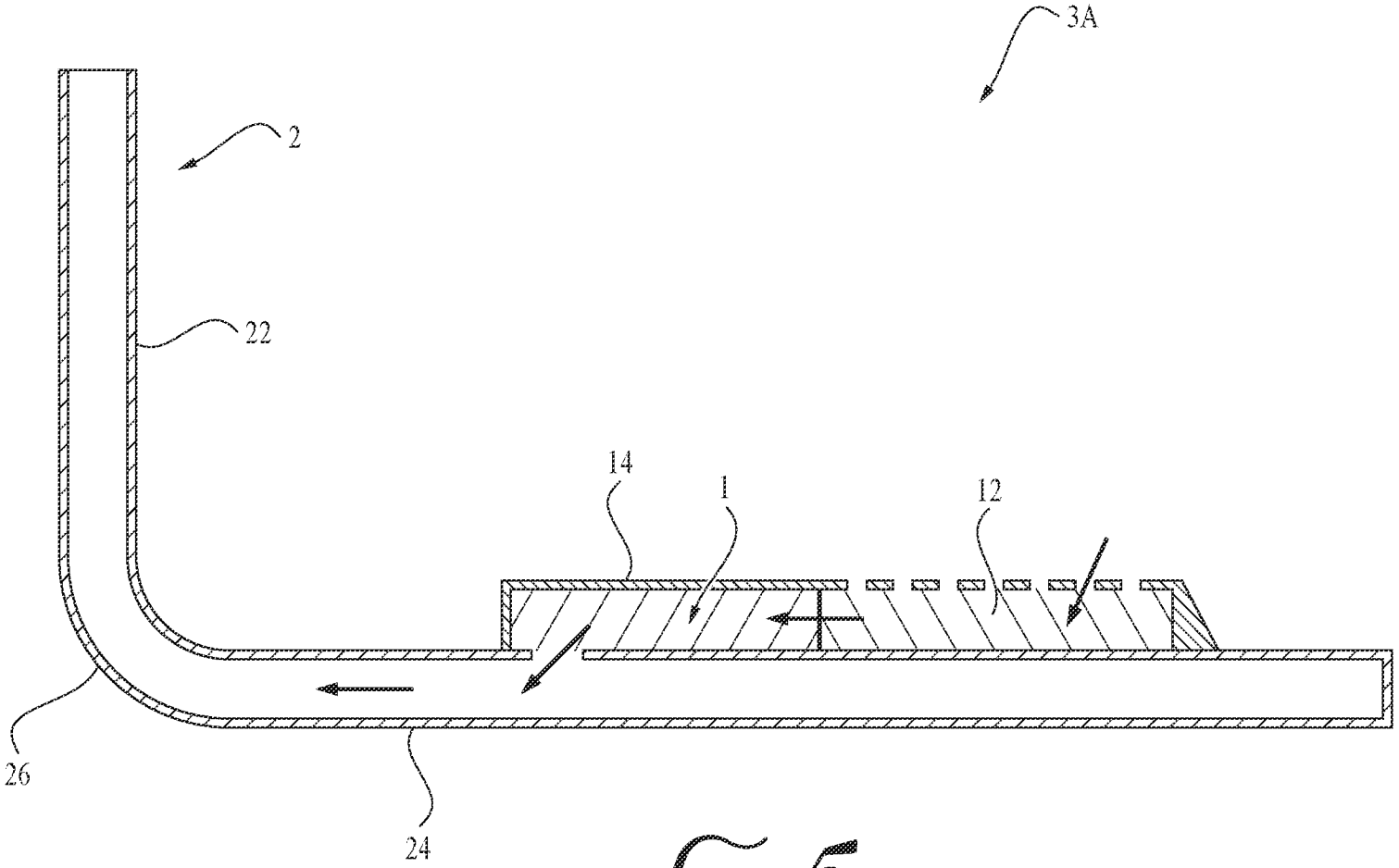
FIG. 5 is a schematic diagram of an exemplary system which may be used for fluid entering a well, according to an embodiment of the present disclosure.

Referring to FIGS. 1, 3 and 5, a system 3A for flowing a fluid in a well uphole includes the tubular 2, a component 30 fluidly coupled to the tubular 2, and a filter 10. The filter 10 may include a housing 106 having an outlet 112 fluidly coupled to the component 30 and a conical permeable element 104 disposed at least partially inside the housing 106. A first opening 108 may be formed at a first axial end of the permeable element 104 and a second opening 110 may be formed at a second axial end of the permeable element 104. Fluid from the formation may enter the filter through the first opening 108 (e.g. after passing through a sand screen). The second opening 110 may be fluidly coupled to the tubular 2. A tapered helical coil 102 may be disposed at least partially inside the permeable element 104. The system 3A further can include an enclosure 14 coupled to the tubular 2 and enclosing the component 30 and the filter 10. In some embodiments, the system 3A further includes a first conduit 202 configured to fluidly couple the outlet 112 and the component 30. In some embodiments, the system 3A may also include a second conduit 204 configured to fluidly couple the second opening 110 and the tubular 2. The component 30 may be sensitive to particles in the fluid. In some embodiments, the filter 10 may be configured to prevent particles above a threshold size from entering the component 30.

In some embodiments, the apparatus 1 may be disposed eccentrically with respect to the tubular 2. In the embodiment of FIG. 5, the apparatus 1 is shown as being disposed on an exterior of the tubular 2. In some embodiments, the apparatus 1 may be disposed on an interior of the tubular 2. In still other embodiments, such as the embodiment of FIG. 6, the apparatus 1 may be disposed concentrically with respect to the tubular 2 and at an interior of the tubular 2. The apparatus 1 may be mechanically connected to the tubular 2 prior to installation within the wellbore, such as fabricating the apparatus 1 as part of a tool on the tubing string. The apparatus 1 may be mechanically connected after the tubular 2 is installed in the wellbore 128, such as with a wireline, slickline, or tubing run or with a pump-down tool.

Referring to FIG. 5, the apparatus 1 (e.g., apparatus 1A (as shown in FIG. 2), apparatus 1B (as shown in FIG. 3), or variations thereof) may be disposed inside an enclosure 14. A sand screen may also be disposed in or may be fluidly coupled to the enclosure 14, for example downhole and/or upstream with respect to the apparatus 1. The first opening 108 may be configured to receive the fluid from the formation through the sand screen 12. In some embodiments, the component 30 and the sand screen 12 may be contained within the enclosure 14. In some embodiments, the apparatus 1 may be permanently mounted to the exterior of the tubular 2 (e.g., a production tubing).

In some embodiments two filters 10 can be arranged in parallel (e.g. with two parallel filter output streams) and/or arranged so that initially fluid flows through only a first filter, but flow can later be switched to flow through the second filter. For example, the enclosure 14 may be configured to open fluid communication to the second filter 10 in response to the first filter 10 clogging. In some embodiments, the enclosure 14 may be mounted to the tubular 2 (e.g., an exterior of the tubular 2). In some embodiments, the enclosure 14 may be mounted to an interior of the tubular 2. In some embodiments, the tubular 2 comprises a vertical portion 22, a curved portion 26, and a horizontal portion 24. The enclosure 14 may be mounted to the horizontal portion 24, the vertical portion 22, or the curved portion 26.

Figure 6:
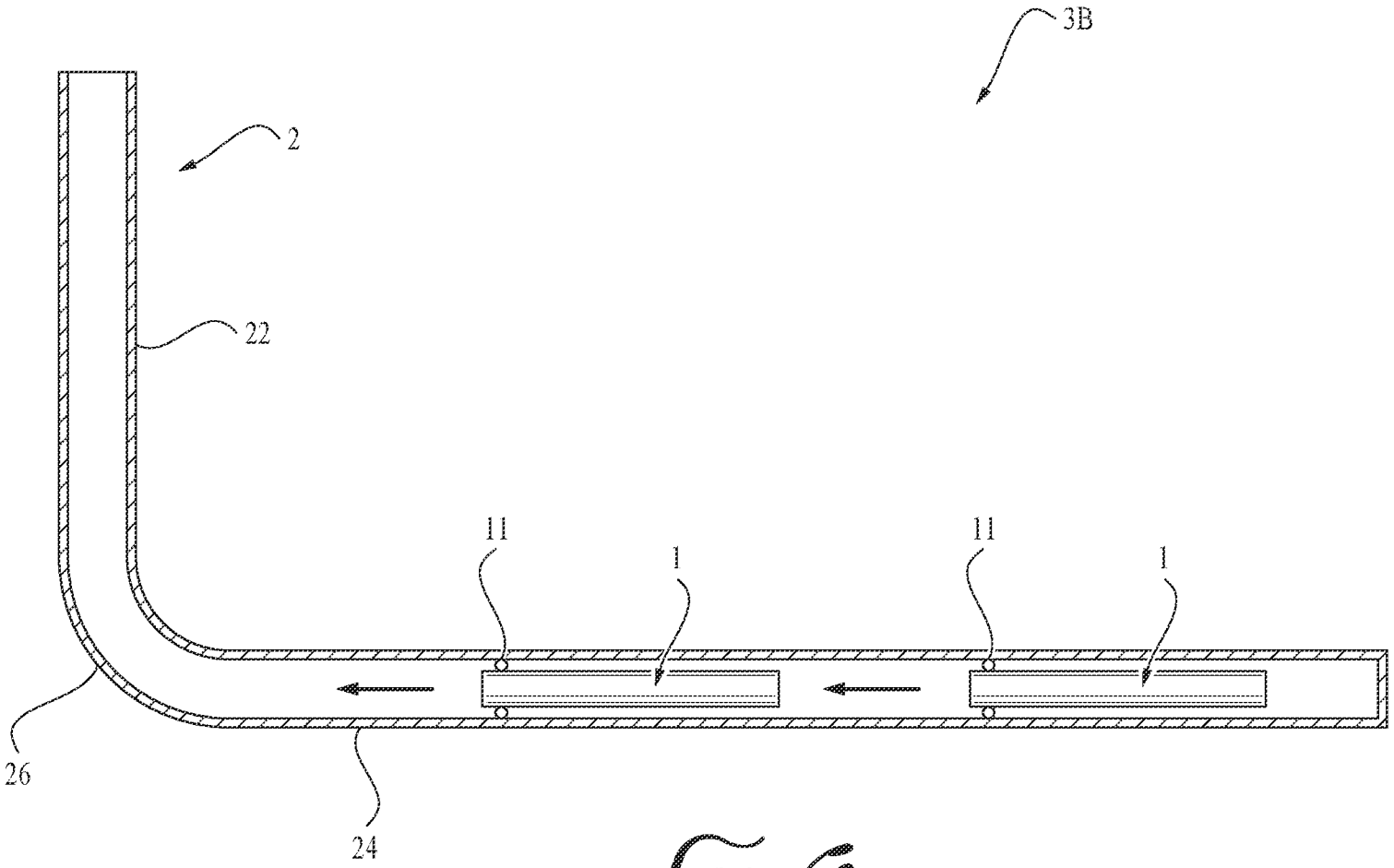
FIG. 6 is a schematic diagram of an exemplary system which may be used for fluid entering a well, according to another embodiment of the present disclosure.

Referring to FIG. 6, in the system 3B, the apparatus 1 (e.g., apparatus 1A (as shown in FIG. 2), apparatus 1B (as shown in FIG. 3), or variations thereof) may be disposed on a nipple 11 of a tubular 2. For example, as shown in FIG. 6 the nipple 11 may be disposed on the horizontal portion 24. The vortex filter 10 may be configured to be mounted on the nipple 11. In some embodiments, the filter 10 (e.g., a first filter 10 and a second filter 10) are each mounted one corresponding nipples 11. In some embodiments, in response to one of the filters 10 clogging (e.g. the upstream filter), flow is diverted around the clogged filter 10. In some embodiments, the tubular 2 may be disposed inside casing (e.g., perforated casing). The nipples may allow the vortex filter 10 and/or other components to be removed for maintenance.

Figure 4:
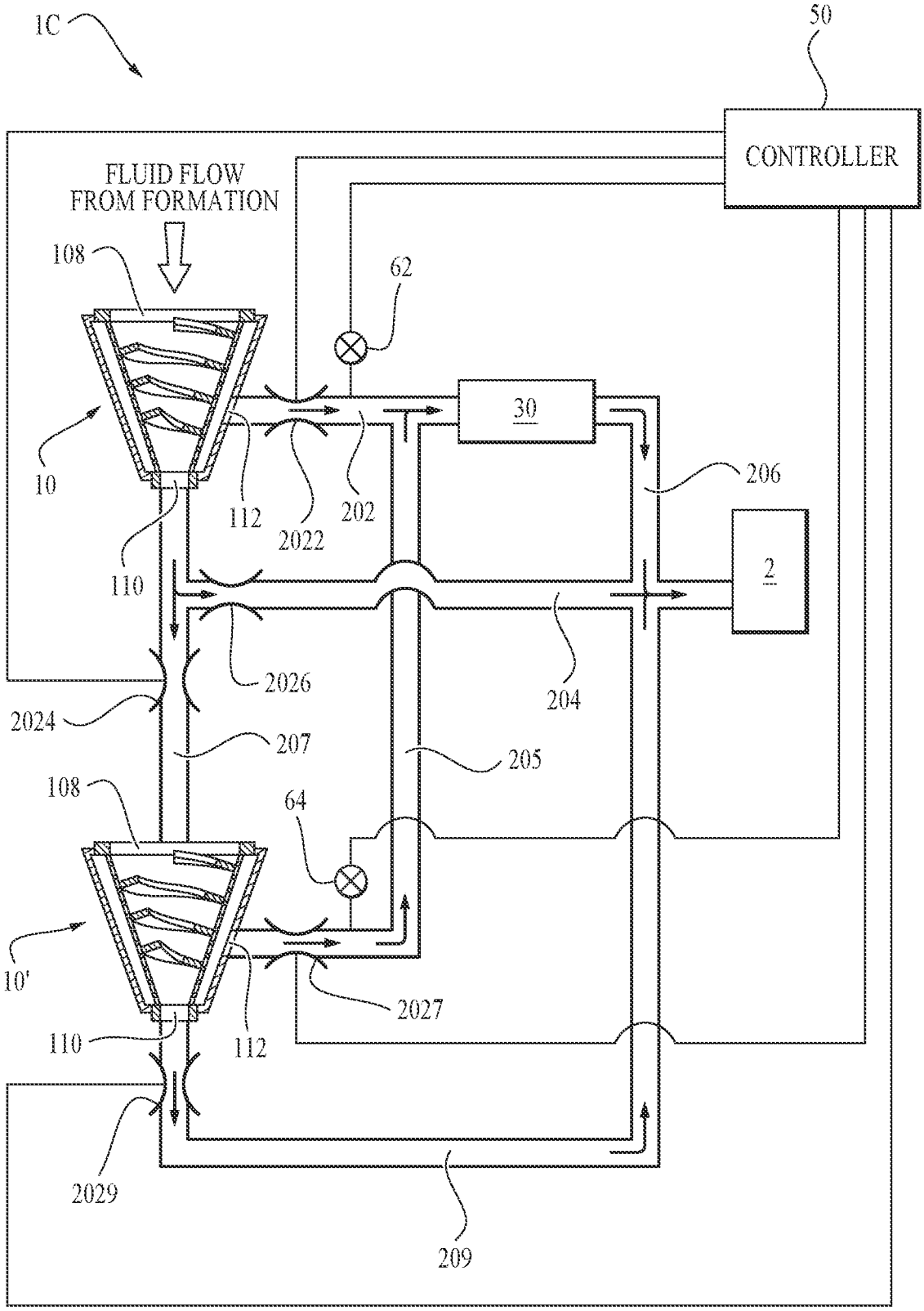
FIG. 4 is a schematic diagram of an exemplary apparatus for supplying clean fluid to a component, according to yet another embodiment of the present disclosure.

Referring to FIG. 4, an exemplary apparatus 1C for supplying clean fluid to a component 30 in a well according to an embodiment is disclosed. A second filter 10' may be arranged in series with the first filter 10 (e.g. so to that the second filter 10' can operate if the first filter 10 becomes clogged). The first opening 108 of the first filter 10 may be fluidly coupled to the formation. The outlet 112 of the first filter 10 may be fluidly coupled to the component 30 by the first conduit 202. The component 30 may be fluidly coupled to the tubular 2 by the third conduit 206. The second opening 110 of the first filter 10 may be fluidly coupled to the tubular 2 by the second conduit 204. The second opening 110 of the first filter 10 may also be fluidly coupled to the first opening 108' of the second filter 10' by the fourth conduit 207 (e.g. so there are diverging flow paths from the second opening 110 of the first filter 10). The outlet 112' of the second filter 10' may be coupled to the component 30 by the fifth conduit 205. The second opening 110' of the second filter 10' may be coupled to the tubular 2 by the sixth conduit 209. A first valve 2022 may be disposed on the first conduit 202; a second valve 2024 may be disposed on the fourth conduit 207; a third valve 2026 may be disposed on the second conduit 204; a fourth valve 2027 may be disposed on the fifth conduit 205; and/or a fifth valve 2029 may be disposed on a sixth conduit 209. A first sensor 62 may be disposed on the first conduit 202, and/or a second sensor 64 may be placed on the fifth conduit 205. The first sensor 62 and/or the second sensor 64 may each be pressure sensors, flowmeters, or any other sensor capable of providing data from which it may be inferred that one or more of the filters is clogged. The apparatus 1C may further include a controller 50. The sensors 62,64 may be communicatively coupled to the controller 50. The first valve 2022, second valve 2024, third valve 2026, fourth valve 2027, and/or fifth valve 2029 may each be operatively coupled to the controller 50, with the controller 50 configured to determine when to open and/or close various valves. In some embodiments, the arrows indicate a direction of flow.

When the first filter 10 is not clogged (e.g., when the controller 50 determines that the first filter 10 is not clogged, for example based on pressure, vibration, or flow rate data from the first sensor 62 and/or the second sensor 64), the first valve 2022 may be open; the third valve 2026 may be open; the second valve 2024 may be closed; the fourth valve 2027 may be closed; and the fifth valve 2029 may be closed. Thus, clean fluid may flow from the outlet 112 of the first filter 10, through the first conduit 202, through the component 30, through the third conduit 206, and into the tubular 2; and fluid does not flow through the second filter 10'. Dirty fluid may flow from the second opening 110 of the first filter 10, through the second conduit 204, and into the tubular 2. As used herein, "dirty fluid" is defined as having a higher concentration of solids than "clean fluid." In some embodiments, "dirty fluid" may have a concentration of solids above a certain level; and "clean fluid" may have concentration of solids below a certain level. In response to the controller 50 determining, for example based on data from the sensor 62, that the first filter 10 is clogged, the controller 50 may send signals to close the first valve 2022, close the third valve 2026, open the second valve 2024, open the fourth valve 2027, and open the fifth valve 2029. Thus, fluid from the formation may pass through the first filter 10 (e.g., with all fluid passing out of the second opening 110 of the first filter 10), through the fourth conduit 207, and into the second filter 10' through the first opening 108' of the second filter 10'. Clean fluid may flow from the outlet 112' of the second filter 10', through the fifth conduit 205, through the component 30, through the third conduit 206, and into the tubular. Dirty fluid may flow from the second opening 110' of the second filter 10', through the sixth conduit 209, and into the tubular 2.

In some embodiments, instead of the controller 50 analyzing the sensor data to operate the valves 2022, 2024, 2026, 2027, 2029, data from the sensors 62 and 64 may be sent to a console, where an operator may view the data and control the valves 2022, 2024, 2026, 2027, 2029 based on the operator's judgement about whether the filters 10,10' are clogged. In some embodiments in which the controller 50 does control the valves 2022, 2024, 2026, 2027, 2029, an operator may override the controller 50 if necessary.

In some embodiments, instead of the controller 50 executing the bypass operation (e.g., controlling the valves 2022, 2024, 2026, 2027, 2029 to close fluid communication between outlet 112 of the first filter 10 and the component 30 and open fluid communication between the outlet 112 of the second valve 2024 and the component 30), bypass may be accomplished purely by mechanical means. For example, in response to one of the filters 10 clogging, a pressure change can cause a shear pin or other retaining element to break/shear, which may alter the flow of fluid to close fluid communication between outlet 112 of the first filter 10 and the component 30 and open fluid communication between the outlet 112' of the second valve 2024 and the component 30. In some embodiments, the second filter 10' may be arranged in series with the first filter 10. In some embodiments, the second filter 10' may be arranged in parallel with the first filter 10.

Figure 8:
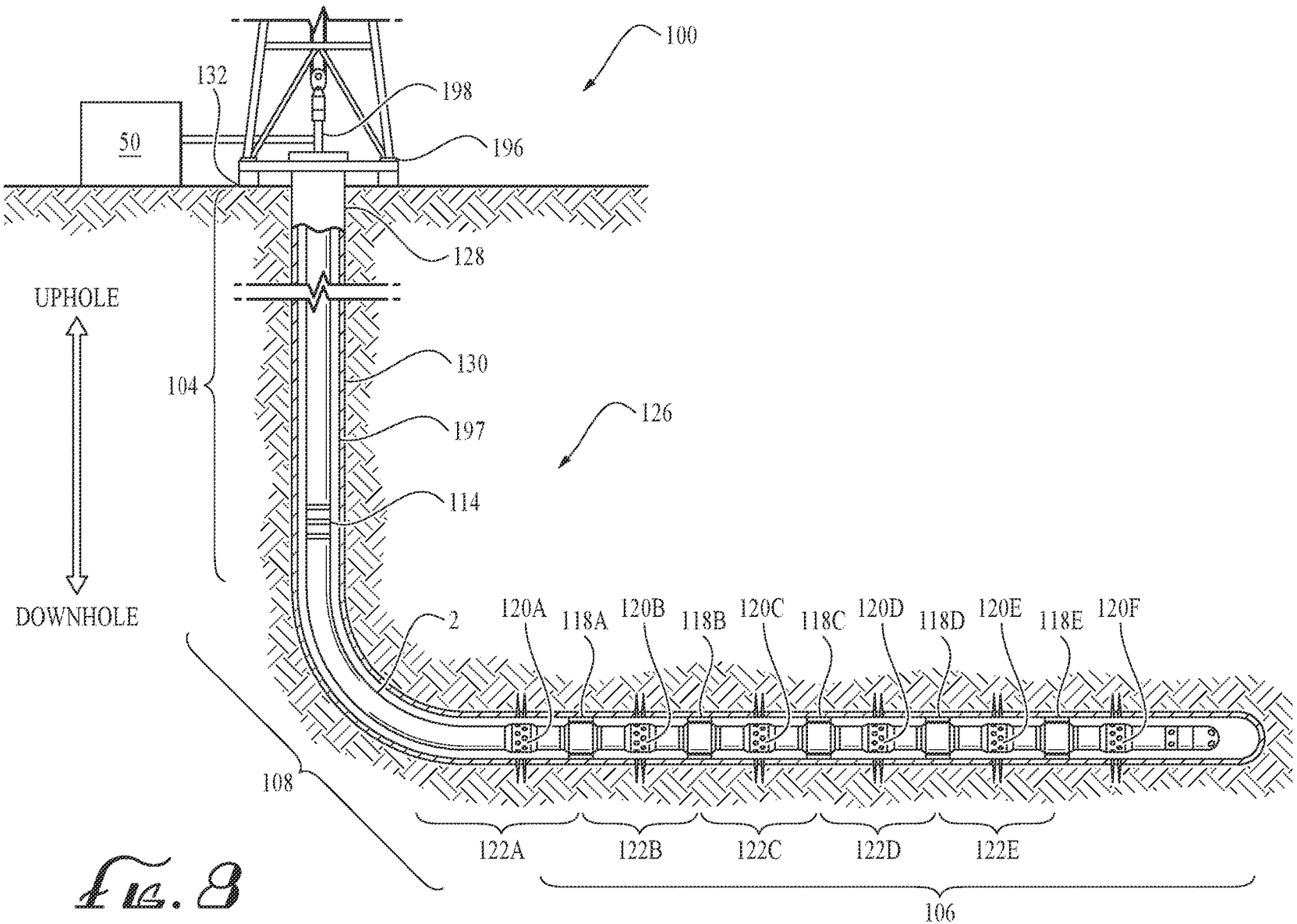
FIG. 8 is a schematic diagram of an exemplary oil well, according to an embodiment.

FIG. 8 is a schematic illustration of an exemplary well system 100. A wellbore 128 may extend from a surface 132 and through a subterranean formation 126 (e.g. which may be expected to produce hydrocarbons or other fluids, for example with the formation 126 including a reservoir of hydrocarbon/formation fluids). The wellbore 128 may have a substantially vertical section 104 and a substantially horizontal section 106, for example with vertical section 104 and horizontal section 106 being connected by a bend 108. The horizontal section 106 and/or the vertical section 104 may extend through the hydrocarbon bearing subterranean formation 126. One or more casing strings 197 may be inserted and cemented into the wellbore 128, for example to prevent fluids from entering the wellbore in an uncontrolled manner. Fluids may comprise any one or more of formation fluids (such as production fluids or hydrocarbons), water, mud, fracturing fluids, or any other type of fluid that may be injected into or received from subterranean formation 126.

The exemplary well system 100 depicted in FIG. 8 may be a closed wellbore in which one or more casing strings 197 are inserted, for example in the vertical section 104, the bend 108, and/or the horizontal section 106, and cemented in place with a cement sheath 130 surrounding the casing string 197. As used herein, the term "closed wellbore" refers to a wellbore comprising a substantially unperforated or unbroken cement sheath in which there is no substantial fluid flowing from the wellbore to the subterranean formation. In some embodiments, the wellbore 128 may be partially completed (for example, partially cased or cemented) and partially uncompleted (for example, uncased and/or uncemented). In other embodiments, the wellbore 128 may be at least partially open if casing strings 197 do not extend through bend 108 and/or horizontal section 106 of the wellbore 128.

A top production packer 114 may be disposed in the vertical section 104 of the wellbore that seals against an innermost surface of the casing string 197. A tubular 2 (e.g., a tubular string) may extend from wellhead 198 along the wellbore. In embodiments, tubular 2 may be a casing string, a liner, a work string, a coiled tubing string, or other tubular 2 as will be appreciated by one of skill in the art with the benefit of this disclosure. In embodiments, the tubular 2 may also be used to inject fluids into the formation 126 via the wellbore. The tubular 2 may include multiple sections that are coupled or joined together by any suitable mechanism to allow the tubular 2 to extend to a desired or predetermined depth in the wellbore.

In some embodiments, the controller 50 may be disposed at or near the wellsite 196. In some embodiments, various other downhole tools may be disposed along tubular 2 as would be appreciated by one of skill in the art with the benefit of this disclosure. Such downhole tools may include, but are not limited to, barriers 118A-E (e.g. packers) and sleeves 120A-F. Barriers 118A-E may engage the inner surface of the wellbore, for example in FIG. 1 the horizontal section 106, dividing the horizontal section 106 into a series of production zones 122A-E. In some embodiments, suitable barriers 118A-E include, but are not limited to packers (e.g., compression set packers, swellable packers, inflatable packers), cement, any other downhole tools, equipment, or devices for isolating zones, or any combination thereof. In some embodiments, some or all components of FIG. 5 (e.g., the apparatus 1, the enclosure 14, and/or the sand screen 12) may be included in the well system 100 shown in FIG. 8. For example, the one or more sleeves 120A-F may serve the function of the sand screen 12 once the fluid has passed through one or more of the sleeves 120A-F. The fluid may then be filtered by the apparatus 1 (e.g., according to any of the configurations of FIGS. 2-4 or any other suitable configuration). In another example, an exterior wall of the sleeves 120A-F may be the enclosure 14, and according to the configuration shown in FIG. 5, the sand screen 12 and the apparatus 1 may be disposed inside the exterior wall of the sleeves 120A-F/enclosure 14. In some embodiments, some or all components of FIG. 6 (e.g., the apparatus 1 and the nipple 11) may be included in the well system 100 shown in FIG. 8. For example, the apparatus 1 and the nipple 11 in the arrangement shown in FIG. 6 may be disposed inside the tubular 2 shown in FIG. 8 (e.g., in the horizontal section 106 of the tubular 2).

Figure 10:
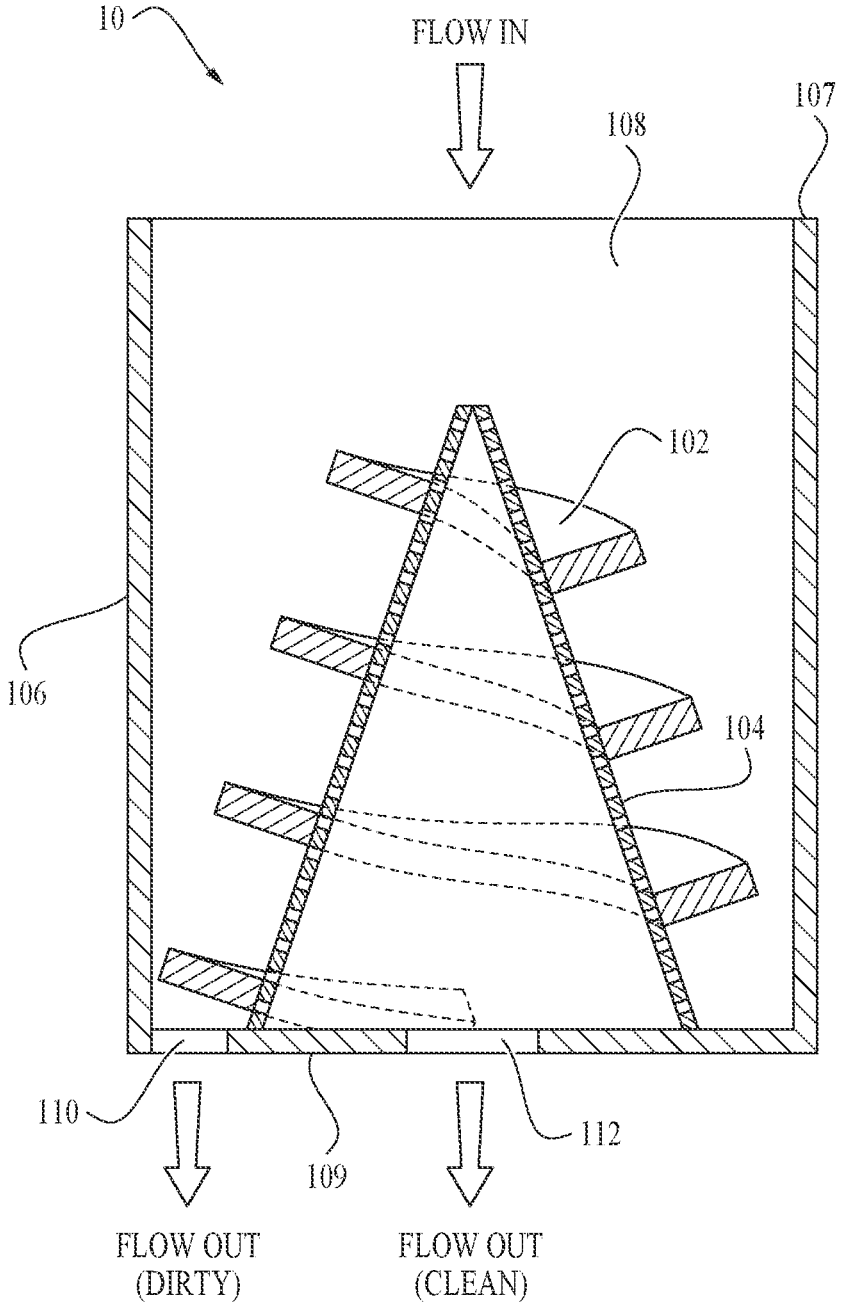
FIG. 10 is a cross-sectional side view of an exemplary vortex filter, according to yet another embodiment.

Referring to FIG. 10, an alternative embodiment of the filter 10 is shown. The permeable element 104 may be in the interior of the housing 106. The permeable element 104 may have a conical shape. The permeable element 104 may taper moving from the second axial end 109 to the first axial end 107. The housing 106 may be cylindrical. The first opening 108 may be formed at the first axial end 107. The second opening 110 may be formed at the second axial end 109. The outlet 112 may be formed at the second axial end 109. The second opening 110 may be disposed radially outward from the outlet 112. The tapered helical coil 102 may be formed on an exterior of the permeable element 104 (e.g., the tapered helical coil 102 may be formed between the permeable element 104 and the housing 106. The tapered helical coil 102 may be attached to the permeable element 104, or alternatively, the tapered helical coil 102 may be disposed proximate to the permeable element 104. In some embodiments, the coil 102 may be disposed upstream of the permeable element 104.

The clean fluid may pass through the center of the housing 106 of and filter 10 dirty fluid may remain on/near the outer diameter of the housing 106. An advantage of this configuration may be that the solids are often denser than the fluid. Higher density components of the fluid stream may be pulled by gravity towards the outside. Thus, the solids may be centripetally concentrated in the dirty flow stream. In this embodiment, the spiral flow of fluid caused by the tapered helical coil 2 may be used to clean the permeable element 104 (e.g., a screen). The tapered helical coil 2 can be attached to the permeable element 104, to the housing 106 (e.g., a wall), or any other suitable position.

Figure 11A:
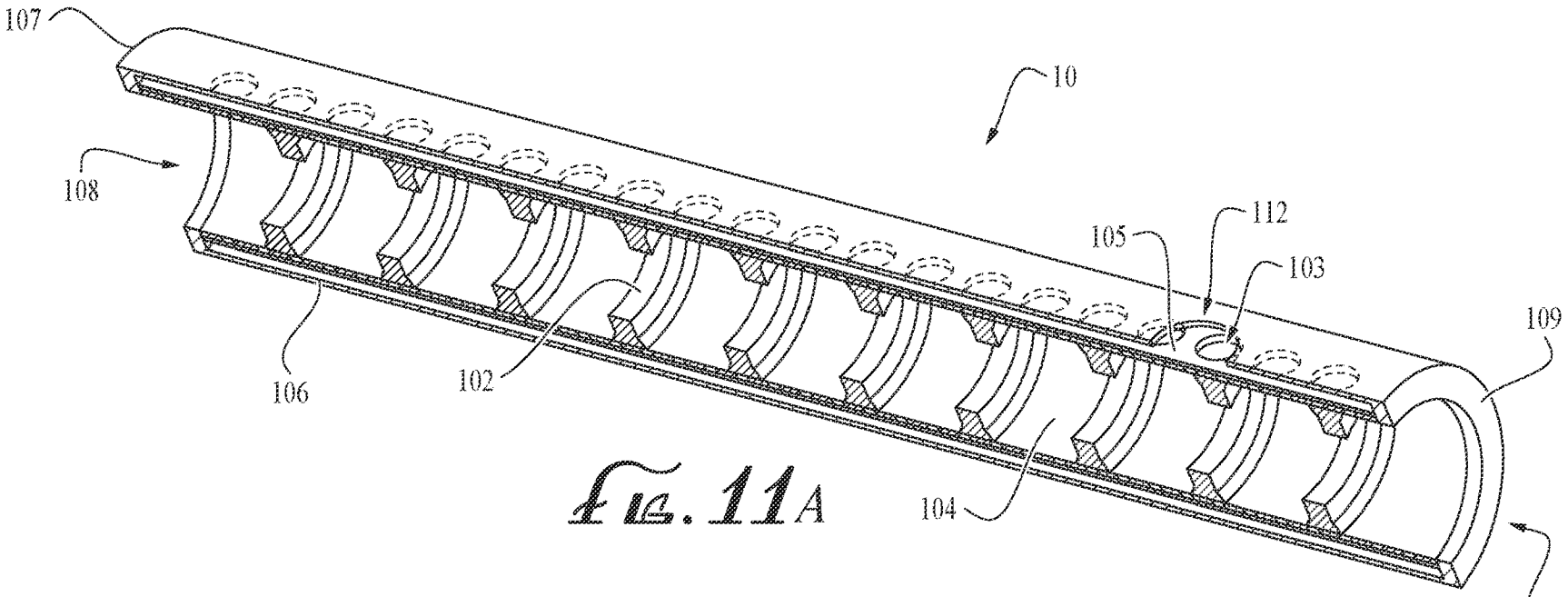
FIG. 11A is a cross-sectional perspective view of an exemplary vortex filter, according to yet another embodiment.
Figure 11B:
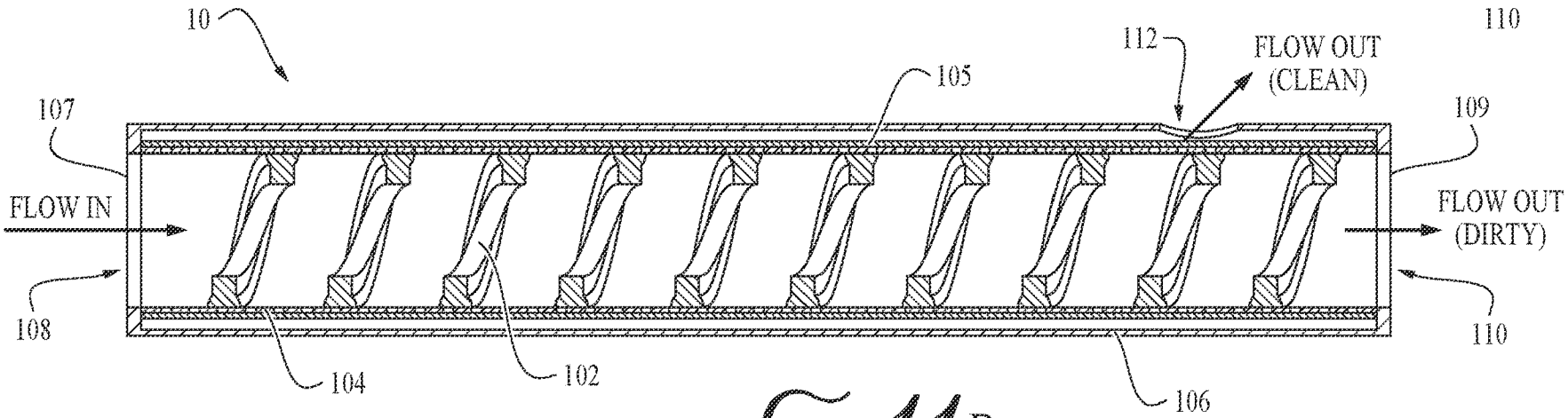
FIG. 11B is a cross-section side view of the vortex filter of FIG. 11A.

Referring to FIG. 11, another alternative embodiment of the filter 10 is shown. It may be a tubular inline formation fluid filter. In some embodiments, the housing 106 may be cylindrical. In some embodiments, the coil 102 may not be tapered and instead be tubular (e.g., the diameter of the coil 102 may be constant along the length of the coil 102). The permeable element 104 may be tubular such that the coil 102 is disposed inside of the permeable element 104 and contacts (e.g., is fastened to) the permeable element 104. The permeable element 104 (e.g., filter element) may be a woven fine mesh, a laser slotted sheet material, a wire wrap tube, or any other suitable material. The filter 10 may further include a drainage tube 105. The drainage tube 105 may contact the permeable element 104 and/or provide structural support for the permeable element 104. The drainage tube 105 may be a welded or wire mesh tube, a perforated sheet metal tube, or any other suitable configuration. The permeable element 104 may be disposed inside of the drainage tube 105. The drainage tube 105 may be disposed between the permeable element 104 and the housing 106.

In embodiments in which the drainage tube 105 is sheet metal, perforations or holes 103 may be formed in the drainage tube 105 for allowing fluid that has passed through the permeable element 104 to enter a volume between the drainage tube 105 and the housing 106. In embodiments in which the drainage tube 105 is a mesh tube, the tube may not have holes. Instead, spacing between the wires of the drainage tube 105 may allow fluid to enter the volume between the drainage tube 105 and the housing 106. The volume may be a clean fluid diverter chamber for diverting clean fluid. In some embodiments, the permeable element 104 may have a filter characteristic of 125 micron or finer and/or the drainage tube 105 may have a filter characteristic of 125 micron or courser.

The housing 106 may comprise an outlet 112 for allowing clean fluid from the fluid diverter chamber to exit the filter 10. There may be a first opening 108 formed in the housing 106 at the first axial end 107 for fluid to enter the filter 10 and a second opening 110 formed in the housing 106 at the second axial end 109 for dirty fluid to exit the filter 10. As previously described, the vortices along the helical path (e.g., generated by the coil) may help clean the permeable element 104, and those particles that were cleaned off of the permeable element 104 may exit the filter 10 through the second opening 110. In some embodiments, the housing may extend vertically inward at the first axial end 107 to form a first flange and/or may extend vertically inward at the second axial end 109 to form a second flange. The flanges may help axially constrain the permeable element 104 and/or the drainage tube 105.

Without wishing to be bound by any particular theory, in the embodiment of FIG. 1, the cone shape of the filter May 10 cause a pressure drop that may cause vortices along the tapered helical path of the coil 102 (e.g., between the ribs of the tapered helical coil 102). In the embodiment of FIG. 11, the length of the filter 10 may cause a pressure drop that may cause vortices along the helical path of the coil 102 (e.g., between the ribs of the helical coil 102).

Figure 7:
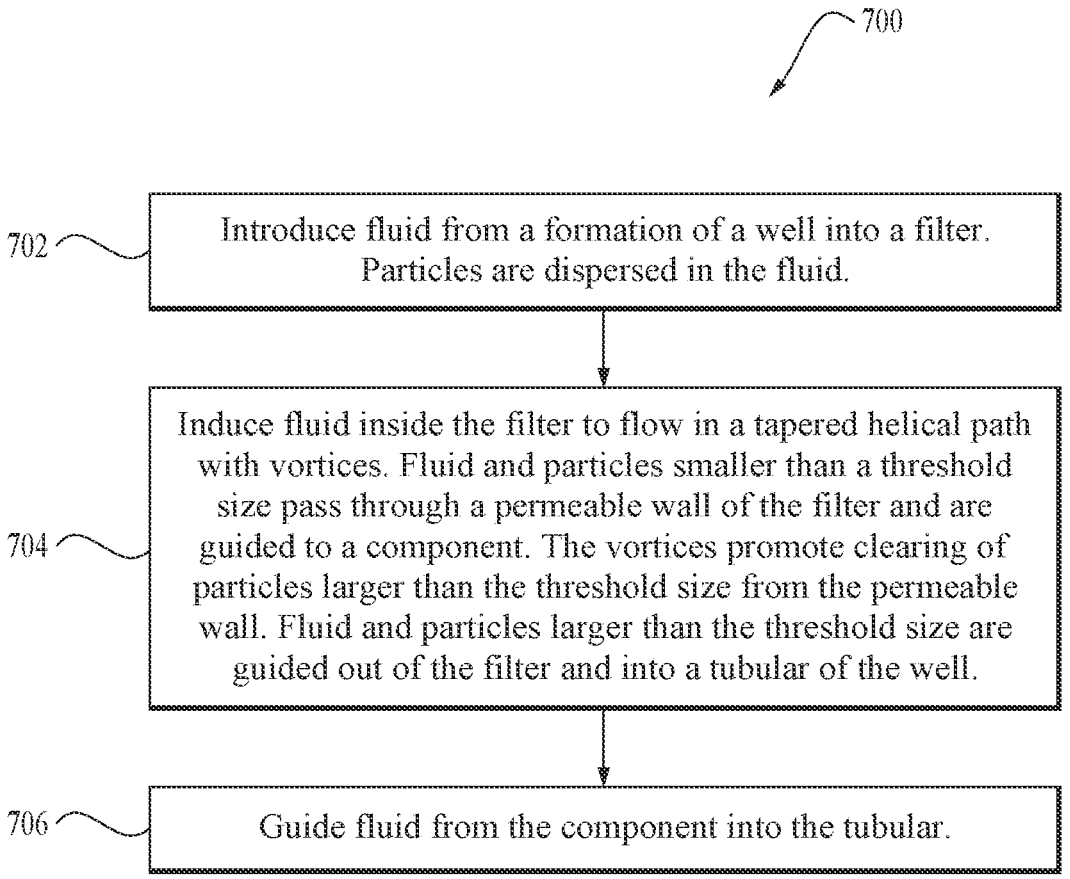
FIG. 7 is a flow diagram of an exemplary method for supplying clean fluid to a component in a well, according to an embodiment.

Referring to FIG. 7, an exemplary method for supplying clean fluid to a component in a well according to an embodiment is disclosed. In some embodiments, step 702 of the method may include introducing fluid from a formation of the well (e.g., a reservoir) into a filter (e.g. a filter similar to disclosed embodiments herein), wherein particles are dispersed in the fluid. Step 704 of the method may include inducing fluid inside the filter to flow (e.g. from the first opening towards the second opening) in a tapered helical path with vortices. In embodiments, inducing fluid inside the filter to flow may comprise inducing a portion of the fluid and particulates sufficiently small to pass though the permeable element of the filter to flow through the permeable element, while preventing larger particulates from passing through. In some embodiments, inducing fluid inside the filter to flow may comprise inducing a portion of the fluid and particulates too large to pass through the permeable element to flow through the second opening 110 of the filter. Fluid and particles smaller than a threshold size pass through a permeable wall of the filter and may be guided to a component, and the vortices may promote clearing of particles larger than the threshold size from the permeable wall. Fluid and particles larger than the threshold size may be guided out of the filter and into a tubular of the well. Step 706 of the method may include guiding fluid from the component into the tubular. In embodiments, introducing fluid from a formation of the well into a filter may comprise introducing the fluid into the filter through the first opening 108. In some embodiments, introducing fluid from a formation of the well into a filter may further comprise first flowing the fluid through a sand screen.

In some embodiments, the threshold size may be based on mesh size of the permeable wall of the filter. In some embodiments, introducing the fluid may include guiding the fluid and particles dispersed in the fluid from the formation of the well into the filter using a conduit. The fluid inside the filter may be induced to flow in the tapered helical path using a tapered helical coil. The fluid inside the filter may be induced to flow in the tapered helical path using the permeable wall, which may be conical. Particles larger than the threshold size may be guided out of the filter and into the tubular of the well using a conduit. The fluid may be guided from the component into the tubular using a conduit. The vortices may revolve around the tapered helical path.

In embodiments, the method may further include pumping acid into the filter, in response to detecting that the filter is clogged. The method may further include inducing backflow inside the filter, in response to detecting that the filter is clogged. The method may further include replacing the filter, in response to detecting that the filter is clogged. The method may further include diverting flow to another filter, in response to detecting that the filter is clogged. Detecting that the filter is clogged may include detecting that the filter is clogged based on a pressure change inside the tubular.

The pressure change may be sensed using a sensor. A controller 50 may receive information regarding the pressure change from the sensor. The controller 50 may then send a command to open a valve, in response to determining that the pressure change resulted from the filter being clogged. In some embodiments, the first filter may be moved to open a fluid pathway to a second filter in response to a pressure differential caused by clogging of the first filter. In some embodiments, the movement may be caused by a mechanism. For example, a pressure differential caused by the first filter clogging may break a shear pin holding the first filter. The first filter may be displaced as a result of the shear pin breaking, which opens the fluid pathway to the second filter.

The method may further include mounting the filter on a nipple in the tubular. The method may further include mounting the filter and the component on an exterior of the tubular. The method may further include pre-filtering the fluid using a sand screen before the fluid is guided into the filter. Use of the sand screen may be advantageous because larger particles may be filtered out before the fluid reaches the vortex filter. The component may include a power generator, a fluid sensor, a flow rate sensor, a fluid actuator, a flow rate controller, a valve, or combinations thereof. In some embodiments, the fluid and particles larger than the threshold size may be guided out of the filter, through another component, and into the tubular of the well. The other component may include a nozzle, a flow control device, a valve, a power generator, or combinations thereof.

The controller 50 may include an information handling system (e.g. comprising one or more processor). A processor or central processing unit (CPU) of the controller 50 may be communicatively coupled to a memory controller hub (MCH) or north bridge. The processor may include, for example a microprocessor, microcontroller, digital signal processor (DSP), application specific integrated circuit (ASIC), or any other digital or analog circuitry configured to interpret and/or execute program instructions and/or process data. Processor may be configured to interpret and/or execute program instructions or other data retrieved and stored in any memory (which may for example be a non-transitory computer-readable medium, configured to have program instructions stored therein, or any other programmable storage device configured to have program instructions stored therein) such as memory or hard drive. Program instructions or other data may constitute portions of a software or application, for example application or data, for carrying out one or more methods described herein. Memory may include read-only memory (ROM), random access memory (RAM), solid state memory, or disk-based memory. Each memory module may include any system, device or apparatus configured to retain program instructions and/or data for a period of time (for example, non-transitory computer-readable media). For example, instructions from a software or application or data may be retrieved and stored in memory for execution or use by processor. In one or more embodiments, the memory or the hard drive may include or comprise one or more non-transitory executable instructions that, when executed by the processor, cause the processor to perform or initiate one or more operations or steps. The information handling system may be preprogrammed or it may be programmed (and reprogrammed) by loading a program from another source (for example, from a CD-ROM, from another computer device through a data network, or in another manner).

The methods described herein may be performed by one or more applications. The one or more applications may comprise one or more software applications, one or more scripts, one or more programs, one or more functions, one or more executables, or one or more other modules that are interpreted or executed by the processor. The one or more applications may include machine-readable instructions for performing one or more of the operations related to any one or more embodiments of the present disclosure. The one or more applications may include machine-readable instructions for generating a user interface or a plot. The one or more applications may obtain input data from the memory, from another local source, or from one or more remote sources (for example, via the one or more communication links). The one or more applications may generate output data and store the output data in the memory, hard drive, in another local medium, or in one or more remote devices (for example, by sending the output data via the communication link).

Memory controller hub may include a memory controller for directing information to or from various system memory components within the information handling system, such as memory, storage element, and hard drive. The memory controller hub may be coupled to memory and a graphics processing unit (GPU). Memory controller hub may also be coupled to an I/O controller hub (ICH) or south bridge. I/O controller hub can be coupled to storage elements of the information handling system, including a storage element, which may comprise a flash ROM that includes a basic input/output system (BIOS) of the computer system. I/O controller hub can also be coupled to the hard drive of the information handling system. I/O controller hub may also be coupled to an I/O chip or interface, for example, a Super I/O chip, which is itself coupled to several of the I/O ports of the computer system, including a keyboard, a mouse, a monitor (or other display) and one or more communications link. Any one or more input/output devices receive and transmit data in analog or digital form over one or more communication links such as a serial link, a wireless link (for example, infrared, radio frequency, or others), a parallel link, or another type of link. The one or more communication links may comprise any type of communication channel, connector, data communication network, or other link. For example, the one or more communication links may comprise a wireless or a wired network, a Local Area Network (LAN), a Wide Area Network (WAN), a private network, a public network (such as the Internet), a WiFi network, a network that includes a satellite link, or another type of data communication network.

Modifications, additions, or omissions may be made to the controller 50 or any components or elements thereof (e.g., processor) without departing from the scope of the present disclosure. Any suitable configurations of components may be used. For example, components of controller 50 may be implemented either as physical or logical components. Furthermore, in some embodiments, functionality associated with components of controller 50 may be implemented in special purpose circuits or components. In other embodiments, functionality associated with components of controller 50 may be implemented in configurable general-purpose circuit or components. For example, components of controller 50 may be implemented by configured computer program instructions.

The apparatus, systems, and method described herein may provide improved filtering, less maintenance, and/or prolonged life of components. There may also be the advantage of not having to replace valves very often (if at all). Not having any moving parts in the filter may be beneficial because the system may be less susceptible to breakdown.

ADDITIONAL DISCLOSURE

The following are non-limiting, specific embodiments in accordance with the present disclosure:

In a first embodiment, an apparatus for supplying clean fluid to a component in a well, comprising: a filter comprising: a housing having an outlet; a conical permeable element disposed at least partially inside the housing, wherein a first opening is formed at a first axial end of the permeable element and a second opening is formed at a second axial end of the permeable element; and a tapered helical coil disposed at least partially inside the permeable element; wherein the outlet and the component are fluidly coupled; and wherein the second opening and a tubular of the well are fluidly coupled (e.g. a first conduit can fluidly couple the outlet and the component; and a second conduit can fluidly couple the second opening and a tubular of the well).

A second embodiment can include the apparatus of the first embodiment further comprising a third conduit fluidly coupling the component and a tubular of the well.

A third embodiment can include the apparatus of the first or second embodiment wherein the first opening is configured to receive fluid from a formation adjacent the well.

A fourth embodiment can include the apparatus of any one of the first through third embodiments wherein the conical permeable element comprises an (e.g. first) open interior volume (e.g. is hollow).

A fifth embodiment can include the apparatus of any one of the first through fourth embodiments wherein the conical permeable element comprises a conical permeable wall.

A sixth embodiment can include the apparatus of any one of the first through fifth embodiments wherein the housing is configured to receive and/or retain the conical permeable element.

A seventh embodiment can include the apparatus of any one of the first through sixth embodiments wherein the housing comprises an (e.g. second) open interior volume (e.g. is hollow).

An eighth embodiment can include the apparatus of any one of the first through seventh embodiments wherein the housing is configured to allow/provide fluid communication of fluid flow in through the first opening and out through the second opening.

A ninth embodiment can include the apparatus of any one of the first through eighth embodiments wherein the housing encompasses/encloses the conical permeable element and/or is configured so that the only fluid flow into the conical permeable element is through the first opening.

A tenth embodiment can include the apparatus of any one of the first through ninth embodiments wherein the filter is a vortex filter.

An eleventh embodiment can include the apparatus of any one of the first through tenth embodiments wherein the filter is conical.

A twelfth embodiment can include the apparatus of any one of the first through eleventh embodiments wherein the housing is conical.

A thirteenth embodiment can include the apparatus of any one of the first through eleventh embodiments wherein the conical shape of the housing is larger than the conical shape of the permeable wall.

A fourteenth embodiment can include the apparatus of any one of the first through thirteenth embodiments wherein the housing comprises approximately the same conical shape as the permeable wall (e.g. approximately the same tapering).

A fifteenth embodiment can include the apparatus of any one of the first through fourteenth embodiments wherein the housing tapers uniformly.

A sixteenth embodiment can include the apparatus of any one of the first through fourteenth embodiments wherein the housing tapers non-uniformly.

A seventeenth embodiment can include the apparatus of any one of the first through sixteenth embodiments wherein the housing tapers differently than the permeable wall.

An eighteenth embodiment can include the apparatus of any one of the first through seventeenth embodiments wherein the housing comprises a housing wall oriented approximately parallel to the permeable wall.

A nineteenth embodiment can include the apparatus of any one of the first through eighteenth embodiments wherein a gap between the housing and the permeable wall is approximately uniform along a length and/or circumference of the permeable wall.

A twentieth embodiment can include the apparatus of any one of the first through nineteenth embodiments wherein the housing encloses a volume (e.g. an exterior volume) outside of the permeable wall and between the first axial end and the second axial end.

A twenty-first embodiment can include the apparatus of any one of the first through twentieth embodiments wherein the volume is disposed between the permeable wall and the housing wall.

A twenty-second embodiment can include the apparatus of any one of the first through twenty-first embodiments wherein the outlet is formed in the housing wall and provides fluid communication between the (e.g. exterior) volume and the first conduit.

A twenty-third embodiment can include the apparatus of any one of the first through twenty-second embodiments wherein the outlet is disposed approximately midway between the first axial end and the second axial end.

A twenty-fourth embodiment can include the apparatus of any one of the first through twenty-third embodiments wherein the outlet comprises a plurality of outlets (e.g. which may co-join to all flow to the first conduit.)

A twenty-fifth embodiment can include the apparatus of any one of the first through twenty-fourth embodiments wherein the outlet is disposed approximately midway between a first axial end of the housing and a second axial end of the housing.

A twenty-sixth embodiment can include the apparatus of any one of the first through twenty-fifth embodiments wherein the first opening has a circular cross section.

A twenty-seventh embodiment can include the apparatus of any one of the first through twenty-sixth embodiments wherein the second opening has a circular cross section.

A twenty-eighth embodiment can include the apparatus of any one of the first through twenty-seventh embodiments wherein the outlet has a circular cross section.

A twenty-ninth embodiment can include the apparatus of any one of the first through twenty-eighth embodiments wherein the first opening is larger than the second opening.

A thirtieth embodiment can include the apparatus of any one of the first through twenty-ninth embodiments wherein the permeable wall is conically-shaped, tapering from the larger first opening to the smaller second opening.

A thirty-first embodiment can include the apparatus of any one of the first through thirtieth embodiments wherein the conical permeable wall tapers at a uniform rate (e.g. a set angle to a plane of the first axial end and/or first opening).

A thirty-second embodiment can include the apparatus of any one of the first through thirtieth embodiments wherein the conical permeable wall tapers non-uniformly (e.g. with at least a portion of the taper comprising curvature or two or more angles).

A thirty-third embodiment can include the apparatus of any one of the first through thirty-second embodiments wherein the permeable wall comprises a mesh.

A thirty-fourth embodiment can include the apparatus of any one of the first through thirty-third embodiments wherein substantially an entire surface of the permeable wall comprises mesh (e.g. at least 90%).

A thirty-fifth embodiment can include the apparatus of any one of the first through thirty-fourth embodiments wherein the mesh allows particles of approximately 10 microns and smaller to pass therethrough and prevents particles of greater than approximately 10 microns from passing therethrough.

A thirty-sixth embodiment can include the apparatus of any one of the first through thirty-fourth embodiments wherein the mesh allows particles of approximately 100-125 microns and smaller to pass therethrough and prevents particles of greater than approximately 100-125 microns from passing therethrough (e.g. approximately 100 micron or approximately 125 micron).

A thirty-seventh embodiment can include the apparatus of any one of the first through thirty-sixth embodiments wherein the mesh is configured to filter particles smaller than particles that the sand filter is configured to filter.

A thirty-eighth embodiment can include the apparatus of any one of the first through thirty-seventh embodiments wherein the particles comprise sand particles.

A thirty-ninth embodiment can include the apparatus of any one of the first through thirty-eighth embodiments wherein the first opening is defined by a first ring at the first axial end.

A fortieth embodiment can include the apparatus of any one of the first through thirty-ninth embodiments wherein the ring is fastened to either one or both of the permeable wall and the housing.

A forty-first embodiment can include the apparatus of any one of the first through fortieth embodiments wherein the second opening is defined by a second ring at the second axial end.

A forty-second embodiment can include the apparatus of any one of the first through forty-first embodiments wherein the second ring is fastened to either one or both of the permeable wall and the housing.

A forty-third embodiment can include the apparatus of any one of the first through forty-second embodiments wherein the first opening is concentric with the second opening (e.g. shares a center axis, even though axially spaced apart).

A forty-fourth embodiment can include the apparatus of any one of the first through forty-third embodiments wherein the first ring is concentric with the second ring (e.g. shares a center axis, even though axially spaced apart).

A forty-fifth embodiment can include the apparatus of any one of the first through forty-fourth embodiments wherein the first ring comprises a first inner diameter, the second ring comprises a second inner diameter, and the first inner diameter is greater than the second inner diameter.

A forty-sixth embodiment can include the apparatus of any one of the first through forty-fifth embodiments wherein the formation is a rock formation.

A forty-seventh embodiment can include the apparatus of any one of the first through forty-sixth embodiments wherein the fluid comprises hydrocarbons.

A forty-eighth embodiment can include the apparatus of any one of the first through forty-seventh embodiments wherein the fluid comprises oil.

A forty-ninth embodiment can include the apparatus of any one of the first through forty-eighth embodiments wherein an outer contour of the coil is tapered.

A fiftieth embodiment can include the apparatus of any one of the first through forty-ninth embodiments wherein an outer contour of the coil corresponds in shape to an inner surface of the permeable wall.

A fifty-first embodiment can include the apparatus of any one of the first through fiftieth embodiments wherein the coil contacts the inner surface of the permeable wall.

A fifty-second embodiment can include the apparatus of any one of the first through fifty-first embodiments wherein the coil is mounted on the inner surface of the permeable wall.

A fifty-third embodiment can include the apparatus of any one of the first through fifty-second embodiments wherein the coil is fixed in relation to the permeable wall.

A fifty-fourth embodiment can include the apparatus of any one of the first through fifty-third embodiments wherein the coil comprises an (e.g. axial) passage, for example extending from the first opening to the second opening (e.g, wherein passage forms an inner contour of the coil).

A fifty-fifth embodiment can include the apparatus of any one of the first through fifty-fourth embodiments wherein the passage tapers moving from the first axial end of the permeable wall to the second axial end of the permeable wall (e.g. the passage narrows).

A fifty-sixth embodiment can include the apparatus of any one of the first through fifty-fifth embodiments wherein the passage extends from the first opening to the second opening.

A fifty-seventh embodiment can include the apparatus of any one of the first through fifty-sixth embodiments wherein the passage is straight (e.g. extends axially, for example approximately centered on the longitudinal center axis of the filter).

A fifty-eighth embodiment can include the apparatus of any one of the first through fifty-seventh embodiments wherein an inner contour of the coil is tapered.

A fifty-ninth embodiment can include the apparatus of any one of the first through fifty-eighth embodiments wherein the coil is configured to induce the fluid to follow a tapered helical path from the first opening towards the second opening.

A sixtieth embodiment can include the apparatus of any one of the first through fifty-ninth embodiments wherein the coil is configured to induce vortices in the fluid about the tapered helical path and/or in proximity to the permeable wall (e.g. its inner surface).

A sixty-first embodiment can include the apparatus of any one of the first through sixtieth embodiments wherein the vortices mitigate buildup of particles on the permeable wall (e.g. clean away particulates that might otherwise clog the mesh of the permeable wall).

A sixty-second embodiment can include the apparatus of any one of the first through sixty-first embodiments wherein the vortices carry particles that are too large to pass through the permeable wall from a surface (e.g. the inner surface) of the permeable wall towards a centerline axis of the filter (e.g. inward towards the passage) and/or downward along a ramp/inclined surface of the coil.

A sixty-third embodiment can include the apparatus of any one of the first through sixty-second embodiments wherein the coil (and its interaction with the inner surface of the permeable wall) is configured so the vortices carry particles that are too large to pass through the permeable wall from an inner surface of the permeable wall towards a centerline of the filter (e.g. inward towards the passage) and/or downward along a ramp/inclined surface of the coil.

A sixty-fourth embodiment can include the apparatus of any one of the first through sixty-third embodiments wherein the coil tapers moving from the first opening towards the second opening.

A sixty-fifth embodiment can include the apparatus of any one of the first through sixty-fourth embodiments wherein the coil has a uniform screw angle.

A sixty-sixth embodiment can include the apparatus of any one of the first through sixty-fifth embodiments wherein the coil has a graduated screw angle.

A sixty-seventh embodiment can include the apparatus of any one of the first through sixty-sixth embodiments wherein the coil forms a ramp/inclined surface spiraling to extend downward from the first opening towards the second opening.

A sixty-eighth embodiment can include the apparatus of any one of the first through sixty-seventh embodiment wherein the coil has a uniform thickness and/or width (e.g. the ramp/inclined surface may have a uniform thickness and/or a uniform width).

A sixty-ninth embodiment can include the apparatus of any one of the first through sixty-eighth embodiments wherein the width and/or thickness is sufficient to withstand forces of the current within the filter.

A seventieth embodiment can include the apparatus of any one of the first through sixty-ninth embodiments wherein the spiraling ramp/inclined surface forms levels, and spacing between the levels is set to optimize fluid flow and filtration.

A seventy-first embodiment can include the apparatus of any one of the first through seventieth embodiments wherein the coil has a tapering thickness and/or width (e.g. the width of the ramp/inclined surface extending way from the permeable wall may become smaller as the coil extends from the first opening towards the second opening and/or the thickness of the material forming the ramp/inclined surface may become thinner as the coil extends form the first opening towards the second opening).

A seventy-second embodiment can include the apparatus of any one of the first through seventy-first embodiments wherein the coil has an open center along a centerline axis of the filter and/or permeable wall.

A seventy-third embodiment can include the apparatus of any one of the first through seventy-second embodiments wherein the open center allows particles that are unable to pass through the permeable wall to exit the filter through the second opening (e.g. fluid having particles too big to pass through the mesh of the permeable wall instead exit through the second opening, for example aided by gravity (e.g. with the filter oriented with the second opening gravitationally below the first opening).

A seventy-fourth embodiment can include the apparatus of any one of the first through seventy-third embodiments wherein the coil is impermeable (e.g. the ramp/inclined surface may be formed of substantially impermeable material).

A seventy-fifth embodiment can include the apparatus of any one of the first through seventy-fourth embodiments wherein the coil is substantially rigid (e.g. substantially resisting deflection based on fluid flow through the filter).

A seventy-sixth embodiment can include the apparatus of any one of the first through seventy-fifth embodiments wherein the coil comprises a ramp/inclined surface.

A seventy-seventh embodiment can include the apparatus of any one of the first through seventy-sixth embodiments wherein the coil extends from the permeable wall approximately perpendicularly with respect to the permeable wall.

A seventy-eighth embodiment can include the apparatus of any one of the first through seventy-seventh embodiments wherein the outlet allows particles that pass through the permeable wall to exit the filter (e.g. fluid without particles larger than allowed to pass through the permeable wall will exit through the filter to the first conduit).

A seventy-ninth embodiment can include the apparatus of any one of the first through seventy-eighth embodiments wherein the component is sensitive to particulates greater than approximately 100 micron or 125 micron or 10 micron (e.g. greater than approximately 100-125 micron, greater than approximately 10-125 micron, or greater than approximately 10-100 micron).

An eightieth embodiment can include the apparatus of any one of the first through seventy-ninth embodiments wherein the component comprises a fluid sensor.

An eighty-first embodiment can include the apparatus of any one of the first through eightieth embodiments wherein the component comprises a turbine generator.

An eighty-second embodiment can include the apparatus of any one of the first through eighty-first embodiments wherein the component comprises a power generator, a fluid sensor, a flow rate sensor, a fluid actuator, a flow rate controller, a valve, or combinations thereof.

An eighty-third embodiment can include the apparatus of any one of the first through eighty-second embodiments further comprising a valve disposed in the first conduit.

An eighty-fourth embodiment can include the apparatus of any one of the first through eighty-third embodiments further comprising a valve disposed in the third conduit.

An eighty-fifth embodiment can include the apparatus of any one of the first through eighty-fourth embodiments further comprising another component (e.g. a non-sensitive component which is capable of handling/not being damaged by fluid having larger particulates).

An eighty-sixth embodiment can include the apparatus of any one of the first through eighty-fifth embodiments wherein the third conduit comprises a conduit/flowpath/portion leading from the second opening to the other component, and a conduit/flowpath/portion leading from the other component to the tubular.

An eighty-seventh embodiment can include the apparatus of any one of the first through eighty-sixth embodiments wherein the other component comprises a turbine generator.

An eighty-eighth embodiment can include the apparatus of any one of the first through eighty-seventh embodiments wherein the other component comprises a nozzle, a flow control device, a valve, a power generator, or combinations thereof.

An eighty-ninth embodiment can include the apparatus of any one of the first through eighty-eighth embodiments wherein flow through the second conduit and flow through the third conduit comingle before entering the tubular.

A ninetieth embodiment can include the apparatus of any one of the first through eighty-ninth embodiments wherein flow through the second conduit enters the tubular through a third opening that is formed in a circumferential surface of the tubular.

A ninety-first embodiment can include the apparatus of any one of the first through ninetieth embodiments wherein flow through the third conduit enters the tubular through the third opening.

A ninety-second embodiment can include the apparatus of any one of the first through ninety-first embodiments wherein the first conduit comprises one or more pipes.

A ninety-third embodiment can include the apparatus of any one of the first through ninety-second embodiments wherein the second conduit comprises one or more pipes.

A ninety-fourth embodiment can include the apparatus of any one of the first through ninety-third embodiments wherein the third conduit comprises one or more pipes.

A ninety-fifth embodiment can include the apparatus of any one of the first through ninety-fourth embodiments wherein the apparatus is disposed eccentrically with respect to the tubular.

A ninety-sixth embodiment can include the apparatus of any one of the first through ninety-fifth embodiments wherein the apparatus is disposed on an exterior of the tubular.

A ninety-seventh embodiment can include the apparatus of any one of the first through ninety-fifth embodiments wherein the apparatus is disposed on and/or in an interior of the tubular.

A ninety-eighth embodiment can include the apparatus of any one of the first through ninety-fourth and ninety-seventh through ninety-seventh embodiments wherein the apparatus is disposed concentrically with respect to the tubular.

A ninety-ninth embodiment can include the apparatus of any one of the first through ninety-fourth embodiments wherein the apparatus is eccentrically disposed on an exterior of the tubular.

A one-hundredth embodiment can include the apparatus of any one of the first through ninety-fourth embodiments wherein the apparatus is concentrically disposed on an interior of tubing.

A one-hundred-first embodiment can include the apparatus of any one of the first through one-hundredth embodiments further comprising a sand screen, wherein the first opening is further configured to receive the fluid from the formation through the sand screen.

A one-hundred-second embodiment can include the apparatus of any one of the first through one-hundred-first embodiments further comprising an enclosure, wherein the filter, the component, and/or the sand screen are contained within the enclosure.

A one-hundred-third embodiment can include the apparatus of any one of the first through one-hundred-second embodiments, further comprising a second filter arranged in series with the filter (e.g., the first filter) (e.g. so to that the other filter can operate if the first filter becomes clogged).

A one-hundred-fourth embodiment can include the apparatus of any one of the first through one-hundred-third embodiments wherein the enclosure is configured to open fluid communication to the second filter in response to the first filter clogging.

A one-hundred-fifth embodiment can include the apparatus of any one of the first through one-hundred-fourth embodiments further comprising another filter arranged in parallel with the filter.

A one-hundred-sixth embodiment can include the apparatus of any one of the first through one-hundred-fifth embodiments wherein the enclosure is mounted to the tubular.

A one-hundred-seventh embodiment can include the apparatus of any one of the first through one-hundred-sixth embodiments wherein the enclosure is mounted to an exterior of the tubular.

A one-hundred-eighth embodiment can include the apparatus of any one of the first through one-hundred-sixth embodiments wherein the enclosure is mounted to an interior of the tubular.

A one-hundred-ninth embodiment can include the apparatus of any one of the first through one-hundred-eighth embodiments wherein the tubular comprises a vertical portion, a curved portion, and a horizontal portion.

A one-hundred-tenth embodiment can include the apparatus of any one of the first through one-hundred-ninth embodiments wherein the enclosure is mounted to the horizontal portion.

A one-hundred-eleventh embodiment can include the apparatus of any one of the first through one-hundred-tenth embodiments wherein the tubular/pipe comprises a nipple.

A one-hundred-twelfth embodiment can include the apparatus of any one of the first through one-hundred-eleventh embodiments wherein the nipple is disposed on and/or in the horizontal portion.

A one-hundred-thirteenth embodiment can include the apparatus of any one of the first through one-hundred-twelfth embodiments wherein the filter is configured to be mounted on the nipple.

A one-hundred-fourteenth embodiment can include the apparatus of any one of the first through one-hundred-thirteenth embodiments wherein the filter (e.g., a first filter) and a second filter are each mounted on nipples.

A one-hundred-fifteenth embodiment can include the apparatus of any one of the first through one-hundred-fourteenth embodiments wherein in response to one of the filters clogging, flow is diverted around the clogged filter.

A one-hundred-sixteenth embodiment can include the apparatus of any one of the first through one-hundred-fifteenth embodiments wherein the tubular is disposed inside casing.

A one-hundred-seventeenth embodiment can include the apparatus of any one of the first through one-hundred-sixteenth embodiments wherein the casing is perforated.

In a one-hundred-eighteenth embodiment, a method for supplying clean fluid to a component in a well, comprises: introducing fluid from a formation of the well into a filter, wherein particles are dispersed in the fluid; inducing fluid inside the filter to flow in a tapered helical path with vortices (e.g., vortices between ribs or a tapered helical coil of the filter), wherein fluid and particles smaller than a threshold size pass through a permeable wall of the filter and are guided to a component, wherein the vortices promote clearing of particles larger than the threshold size from the permeable wall, and wherein fluid and particles larger than the threshold size are guided out of the filter and into a tubular of the well; and guiding fluid from the component into the tubular.

A one-hundredth-nineteenth embodiment can include the method of the one-hundred-eighteenth embodiment using the apparatus of any one of the first through one-hundred-seventeenth embodiments.

A one-hundred-twentieth embodiment can include the method of the one-hundred-eighteenth or one-hundred-nineteenth embodiments wherein threshold size is based on mesh size of the permeable wall.

A one-hundred-twenty-first embodiment can include the method of any one of the one-hundred-eighteenth through one-hundred-twentieth embodiments wherein the introducing of the fluid comprises guiding the fluid and particles dispersed in the fluid from the formation of the well into the filter using a conduit.

A one-hundred-twenty-second embodiment can include the method of any one of the one-hundred-eighteenth through one-hundred-twenty-first embodiments wherein the inducing of the fluid inside the filter to flow in the tapered helical path comprises inducing the fluid inside the filter to flow in the tapered helical path using a tapered helical coil (e.g. flowing fluid over the helical coil) and/or using the permeable wall, which is conical.

A one-hundred-twenty-third embodiment can include the method of any one of the one-hundred-eighteenth through one-hundred-twenty-second embodiments wherein the guiding of the particles larger than the threshold size out of the filter and into the tubular of the well comprises guiding of the particles larger than the threshold size out of the filter and into the tubular of the well using a conduit.

A one-hundred-twenty-fourth embodiment can include the method of any one of the one-hundred-eighteenth through one-hundred-twenty-third embodiments wherein the guiding of the fluid from the component into the tubular comprises guiding the fluid from the component into the tubular using a conduit.

A one-hundred-twenty-fifth embodiment can include the method of any one of the one-hundred-eighteenth through one-hundred-twenty-fourth embodiments wherein the vortices revolve around the tapered helical path.

A one-hundred-twenty-sixth embodiment can include the method of any one of the one-hundred-eighteenth through one-hundred-twenty-fifth embodiments further comprising pumping acid into the filter, in response to detecting that the filter is clogged.

A one-hundred-twenty-seventh embodiment can include the method of any one of the one-hundred-eighteenth through one-hundred-twenty-sixth embodiments further comprising inducing backflow inside the filter, in response to detecting that the filter is clogged.

A one-hundred-twenty-eighth embodiment can include the method of any one of the one-hundred-eighteenth through one-hundred-twenty-seventh embodiments further comprising replacing the filter, in response to detecting that the filter is clogged.

A one-hundred-twenty-ninth embodiment can include the method of any one of the one-hundred-eighteenth through one-hundred-twenty-eighth embodiments further comprising diverting flow to another filter, in response to detecting that the filter is clogged.

A one-hundred-thirtieth embodiment can include the method of any one of the one-hundred-eighteenth through one-hundred-twenty-ninth embodiments wherein the detecting that the filter is clogged comprises detecting that the filter is clogged based on a pressure change inside the tubular and/or inside a conduit.

A one-hundred-thirty-first embodiment can include the method of any one of the one-hundred-eighteenth through one-hundred-thirtieth embodiments wherein the detecting of the pressure change comprises sensing the pressure change using a sensor.

A one-hundred-thirty-second embodiment can include the method of any one of the one-hundred-eighteenth through one-hundred-thirty-first embodiments wherein the diverting of the flow to the other filter comprises receiving, by a controller, information regarding the pressure change from the sensor, and sending, by the controller, a command to open a valve (and in some embodiments, close another valve), in response to determining that the pressure change resulted from the filter being clogging.

A one-hundred-thirty-third embodiment can include the method of any one of the one-hundred-eighteenth through one-hundred-thirty-second embodiments wherein the first filter is moved to open a fluid pathway to the second filter in response to a pressure differential caused by clogging of the first filter.

A one-hundred-thirty-fourth embodiment can include the method of any one of the one-hundred-eighteenth through one-hundred-thirty-third embodiments wherein the movement is caused by a mechanism.

A one-hundred-thirty-fifth embodiment can include the method of any one of the one-hundred-eighteenth through one-hundred-thirty-fourth embodiments wherein the pressure differential breaks/shears a shear pin or other shearable retaining element holding the first filter and the movement of the first filter is caused by the shear pin breaking.

A one-hundred-thirty-sixth embodiment can include the method of any one of the one-hundred-eighteenth through one-hundred-thirty-fifth embodiments further comprising mounting the filter on a nipple in the tubular.

A one-hundred-thirty-seventh embodiment can include the method of any one of the one-hundred-eighteenth through one-hundred-thirty-sixth embodiments further comprising mounting the filter and the component on an exterior of the tubular.

A one-hundred-thirty-eighth embodiment can include the method of any one of the one-hundred-eighteenth through one-hundred-thirty-seventh embodiments further comprising pre-filtering the fluid using a sand screen before the fluid is guided into the filter.

A one-hundred-thirty-ninth embodiment can include the method of any one of the one-hundred-eighteenth through one-hundred-thirty-eighth embodiments wherein the component comprises a power generator, a fluid sensor, a flow rate sensor, a fluid actuator, a flow rate controller, a valve, or combinations thereof.

A one-hundred-fortieth embodiment can include the method of any one of the one-hundred-eighteenth through one-hundred-thirty-ninth embodiments wherein the fluid and particles larger than the threshold size are guided out of the filter, through another component (e.g. which is not sensitive to particles), and into the tubular of the well.

A one-hundred-forty-first embodiment can include the method of any one of the one-hundred-eighteenth through one-hundred-fortieth embodiments wherein the other component comprises a nozzle, a flow control device, a valve, a power generator, or combinations thereof.

In a one-hundred-forty-second embodiment, a system for processing a fluid in a well, comprises: a tubular; a component fluidly coupled to the tubular; a filter (e.g. which may be similar to any one of the first to one-hundred-seventeenth embodiments) comprising: a housing having an outlet fluidly coupled to the component; a conical permeable element disposed at least partially inside the housing, wherein a first opening is formed at a first axial end of the permeable element and a second opening is formed at a second axial end of the permeable element, and wherein the second opening is fluidly coupled to the tubular; and a tapered helical coil disposed at least partially inside the permeable element; an enclosure coupled to the tubular and enclosing the component and the filter.

A one-hundred-forty-third embodiment can include the system of the one-hundred-forty-second embodiment combined with any of the first through one-hundred-forty-first embodiments.

A one-hundred-forty-fourth embodiment can include the system of the one-hundred-forty-second or one-hundred-forty-third embodiments further comprising a first conduit configured to fluidly couple the outlet and the component.

A one-hundred-forty-fifth embodiment can include the system of any one of the one-hundred-forty-second through one-hundred-forty-fourth embodiments further comprising a second conduit configured to fluidly couple the second opening and the tubular.

A one-hundred-forty-sixth embodiment can include the system of any one of the one-hundred-forty-second through one-hundred-forty-fifth embodiments wherein the component is sensitive to particles in the fluid.

A one-hundred-forty-seventh embodiment can include the system of any one of the one-hundred-forty-second through one-hundred-forty-sixth embodiments wherein the filter is configured to prevent particles above a threshold size from entering the component.

A one-hundred-forty-eighth embodiment can include the method of any one of the one-hundred-eighteenth to one-hundred-forty-first embodiments, further comprising pumping the fluid uphole (e.g. to the surface), for example using a surface pump and/or pump disposed downhole in the well, such as an ESP pump.

A one-hundred-forty-ninth embodiment can include the method of any one of the one-hundred-eighteenth to one-hundred-forty-first and one-hundred forty-eighth embodiments, further comprising running the tubular downhole in the well, and isolating a portion of the well (e.g. setting packers), wherein the portion of the well that is isolated is in fluid communication with the filter.

A one-hundred fiftieth embodiment can include the method of the one-hundred forty-eighth to one-hundred forty-ninth embodiments, further comprising producing fluid (e.g. hydrocarbons, such as oil and/or gas) from the well.

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Disclosure of a singular element should be understood to provide support for a plurality of the element. It is contemplated that elements of the present disclosure may be duplicated in any suitable quantity.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" does not require selection of only one element. Thus, the phrase "A or B" is satisfied by either element from the set {A, B}, including multiples of any either element; and the phrase "A, B, or C" is satisfied by any element from the set {A, B, C} or any combination thereof, including multiples of any element. A clause that recites "A, B, or C" can be infringed with only one of the listed items, multiple of the listed items, and one or more of the items in the list and another item not listed.

As used herein, the terms "a" and "an" mean "one or more." As used herein, the term "the" means "the one or more." Thus, the phrase "an element" means "one or more elements;" and the phrase "the element" means "the one or more elements."

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A filter for supplying fluid to a component in a well, comprising:

a housing having an outlet;

a permeable element disposed at least partially inside the housing, wherein a first opening is formed at or proximate to a first axial end of the permeable element and a second opening is formed at or proximate to a second axial end of the permeable element; and a helical coil disposed proximate to the permeable element, wherein the outlet and the component are fluidly coupled, and wherein the second opening and a tubular of the well are fluidly coupled, and wherein the filter is configured such that fluid and particles smaller than a threshold size pass through the permeable element and are guided to the component, and fluid and particles larger than the threshold size are guided out of the filter and into the tubular of the well.

2. The filter of claim 1, wherein a first conduit fluidly couples the outlet and the component, a second conduit fluidly couples the second opening and the tubular of the well, and a third conduit fluidly couples the component and the tubular of the well.

3. The filter of claim 2, wherein flow through the third conduit enters the tubular through an opening in the tubular.

4. The filter of claim 1, wherein the first opening is configured to receive fluid from a formation adjacent the well.

5. The filter of claim 1, wherein the permeable element comprises a mesh.

6. The filter of claim 1, wherein the helical coil is configured to induce vortices in the fluid about a tapered helical path.

7. The filter of claim 6, wherein the vortices mitigate buildup of particles on the permeable element.

8. The filter of claim 1, wherein the component comprises a power generator, a fluid sensor, a flow rate sensor, a fluid actuator, a flow rate controller, a valve, or combinations thereof.

9. The apparatus of claim 1, wherein the particles are dispersed in the fluid, and wherein the filter is further configured such that fluid is introduced from a formation of the well into the filter and fluid inside the filter is induced to flow in a tapered helical path with vortices that promote clearing of particles larger than the threshold size from the permeable element.

10. The apparatus of claim 9, wherein fluid is guided from the component into the tubular.

11. The apparatus of claim 10, wherein the permeable element comprises a permeable wall.

12. A method for supplying fluid to a component in a well, the method comprising:

introducing fluid from a formation of the well into a filter, wherein particles are dispersed in the fluid;

inducing fluid inside the filter to flow in a tapered helical path with vortices, wherein fluid and particles smaller than a threshold size pass through a permeable wall of the filter and are guided to a component, wherein the vortices promote clearing of particles larger than the threshold size from the permeable wall, and wherein fluid and particles larger than the threshold size are guided out of the filter and into a tubular of the well; and guiding fluid from the component into the tubular.

13. The method of claim 12, wherein threshold size is based on mesh size of the permeable wall.

14. The method of claim 12, wherein the introducing of the fluid comprises guiding the fluid and particles dispersed in the fluid from the formation of the well into the filter using a conduit.

15. The method of claim 12, wherein the inducing of the fluid inside the filter to flow in the tapered helical path comprises inducing the fluid inside the filter to flow in the tapered helical path using a tapered helical coil.

16. The method of claim 12, wherein the component comprises a power generator, a fluid sensor, a flow rate sensor, a fluid actuator, a flow rate controller, a valve, or combinations thereof.

17. The method of claim 12, further comprising diverting flow to another filter, in response to detecting that the filter is clogged.

18. A system for flowing a fluid in a well, comprising:

a tubular;

a component fluidly coupled to the tubular, wherein the component comprises a power generator, a fluid sensor, a flow rate sensor, a fluid actuator, a flow rate controller, a valve, or combinations thereof;

a filter comprising:

a housing having an outlet fluidly coupled to the component;

a permeable element disposed at least partially inside the housing, wherein a first opening is formed at or proximate to a first axial end of the permeable element and a second opening is formed at or proximate to a second axial end of the permeable element, wherein the first opening is fluidly coupled to a formation of the well, and wherein the second opening is fluidly coupled to the tubular; and a helix disposed proximate to the permeable element; and an enclosure coupled to the tubular and enclosing the component and the filter.

19. The system of claim 18, further comprising:

a first conduit fluidly coupling the outlet and the component;

a second conduit fluidly coupling the second opening and the tubular; and a third conduit fluidly coupling the component and the tubular.

20. The system of claim 18, wherein the tapered helical coil is configured to induce a vortex in the fluid.

* * * * *